US008550585B2

(12) United States Patent
Tsuchiya

(10) Patent No.: US 8,550,585 B2
(45) Date of Patent: Oct. 8, 2013

(54) LIQUID EJECTING APPARATUS

(75) Inventor: Taisuke Tsuchiya, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 183 days.

(21) Appl. No.: 13/043,376

(22) Filed: Mar. 8, 2011

(65) Prior Publication Data

US 2011/0234662 A1 Sep. 29, 2011

(30) Foreign Application Priority Data

Mar. 29, 2010 (JP) ..... 2010-074386

(51) Int. Cl.
*B41J 29/38* (2006.01)
*B41J 2/165* (2006.01)

(52) U.S. Cl.
USPC ..... 347/9; 347/22; 347/23; 347/33

(58) Field of Classification Search
USPC ..... 347/9, 14, 20, 22–23, 31, 33
See application file for complete search history.

(56) References Cited

U.S. PATENT DOCUMENTS

| | | | |
|---|---|---|---|
| 5,966,145 | A | 10/1999 | Miura et al. |
| 2004/0189737 | A1 | 9/2004 | Nakashima |
| 2005/0078145 | A1 | 4/2005 | Inoue |

FOREIGN PATENT DOCUMENTS

| | | | |
|---|---|---|---|
| JP | H06-278275 | A | 10/1994 |
| JP | 2004-106359 | A | 4/2004 |
| JP | 2004-291483 | A | 10/2004 |
| JP | 2005-088459 | A | 4/2005 |
| JP | 2005-119284 | A | 5/2005 |
| JP | 2008-201061 | A | 9/2008 |

OTHER PUBLICATIONS

Japan Patent Office, Notification of Reason for Refusal for Japanese Patent Application No. 2010-074386, dispatched Mar. 13, 2012.

*Primary Examiner* — Jason Uhlenhake
(74) *Attorney, Agent, or Firm* — Baker Botts L.L.P.

(57) ABSTRACT

Liquid ejecting apparatus having ink-jet head and pre-coating head from which ink for forming an image on recording medium and pre-coating liquid reacting with the ink are respectively ejected onto respective predetermined first and second areas of conveyor belt provided for feeding the recording medium, during maintenance operation, wherein the ejected ink and pre-coating liquid are removed from the first and second areas of the conveyor belt by respective blades of respective ink and liquid cleaning mechanisms, when the first and second areas of the conveyor belt are spaced apart from the blades of the respective liquid and ink cleaning mechanisms, whereby the ejected ink and pre-coating liquid do not mix and react with each other during the maintenance operation.

16 Claims, 19 Drawing Sheets

LIQUID EJECTING APPARATUS

CROSS REFERENCE TO RELATED APPLICATION

The present application claims the priority from Japanese Patent Application No. 2010-074386 filed Mar. 29, 2010, the disclosure of which is herein incorporated by reference in its entirety.

BACKGROUND OF THE INVENTION

1. Field of the Invention

The present invention relates to a liquid ejecting apparatus constructed to eject droplets of a liquid from a plurality of liquid-ejecting nozzles.

2. Description of Related Art

An ink-jet printer having ink jet heads of a line printing type each provided with a plurality of ink-ejecting nozzles is known as an example of a liquid ejecting apparatus. The ink-jet printer further has a sheet conveyor belt which is rotated to feed a recording medium in the form of a paper sheet and which has a predetermined ink receiving area onto which masses of an ink having a relatively high degree of viscosity are ejected from the ink-ejecting nozzles during a purging operation of the ink-jet head. The ink-jet printer further has a belt cleaner provided to perform a cleaning operation to remove the ink from the purging area of the sheet conveyor belt.

There is also known an ink-jet printer having a treatment-liquid ejecting head configured to eject a treatment liquid for causing aggregation (cohesion) or deposition (precipitation) of chromogenic components of inks, onto an area of a paper sheet in which dots of the inks are formed, so that the ejected treatment liquid reduces the degree of blotting of the ink dots and improves the coloring effects of the inks.

SUMMARY OF THE INVENTION

Where the ink jet printer has the above-described treatment-liquid ejecting head, and a cleaning mechanism like the above-described belt cleaner for cleaning a medium transfer mechanism like the above-described sheet conveyor belt, the inks ejected from the ink-jet heads and the treatment liquid ejected from the treatment-liquid ejecting head may be mixed together on the sheet transfer surface of the sheet conveyor belt and the belt cleaner, giving rise to a risk of production of substances as a result of the aggregation (cohesion) or deposition (precipitation) of the chromogenic components. The produced substances may adhere to the sheet transfer surface of the sheet conveyor belt and the belt cleaner, leading to a problem of contamination of the recording medium with the by-products, and problems of reduction of the medium feeding capability of the medium transfer mechanism and reduction of the cleaning capability of the cleaning mechanism.

The present invention was made in view of the background art described above. It is therefore an object of the present invention to provide a liquid ejecting apparatus which has the cleaning mechanism for cleaning the medium transfer mechanism and the treatment-liquid ejecting head and which is configured to prevent the reduction of the medium feeding function of the medium transfer mechanism and the reduction of the cleaning function of the cleaning mechanism.

The object indicated above can be achieved according to the principle of this invention, which provides a liquid ejecting apparatus comprising: a medium transfer mechanism including a conveyor belt for feeding a recording medium, the conveyor belt having a medium support surface on which the recording medium is placed; a first-liquid ejecting head having first ejecting nozzles for ejecting a first liquid to form an image on the recording medium being fed by the conveyor belt in a feeding direction; a second-liquid ejecting head spaced apart from the first-liquid ejecting head in the feeding direction and having second ejecting nozzles for ejecting a second liquid which causes aggregation or deposition of components of the first liquid; a first-liquid ejection control portion configured to control the first-liquid ejecting head to eject the first liquid from the first ejecting nozzles onto the medium support surface of the conveyor belt; a second-liquid ejection control portion configured to control the second-liquid ejecting head to eject the second liquid from the second ejecting nozzles onto the medium support surface of the conveyor belt; a first cleaning mechanism including a first removing member configured to contact the medium support surface and remove the first liquid from the medium support surface; a second cleaning mechanism including a second removing member configured to contact the medium support surface and remove the second liquid from the medium support surface; and a medium transfer and cleaning control portion configured to control the medium transfer mechanism and the first and second cleaning mechanisms, and wherein the medium transfer and cleaning control portion control the medium transfer mechanism and the first cleaning mechanism, after the first liquid is ejected from the first ejecting nozzles onto the medium support surface under the control of the first-liquid ejection control portion, to enable the first removing member to remove the ejected first liquid from the medium support surface, without the first liquid on the medium support surface reaching a position of a part of the conveyor belt to which the second removing member is opposed, and after the second liquid is ejected from the second ejecting nozzles onto the medium support surface under the control of the second-liquid ejection control portion, to enable the second removing member to remove the ejected second liquid from the medium support surface, without the second liquid on the medium support surface reaching a position of another part of the conveyor belt to which the first removing member is opposed.

BRIEF DESCRIPTION OF THE DRAWINGS

The above and other objects, features, advantages and technical and industrial significance of the present invention will be better understood by reading the following detailed description of preferred embodiments of the present invention, when considered in connection with the accompanying drawings, in which:

FIGS. 9A and 9B through FIGS. 18A and 18B are schematic side elevational views showing respective ink-jet printers according to respective fourth through thirteenth embodiments of the invention.

DETAILED DESCRIPTION OF THE PREFERRED EMBODIMENTS

The preferred embodiments of this invention will be described by reference to the accompanying drawings.

First Embodiment

Figure 1:
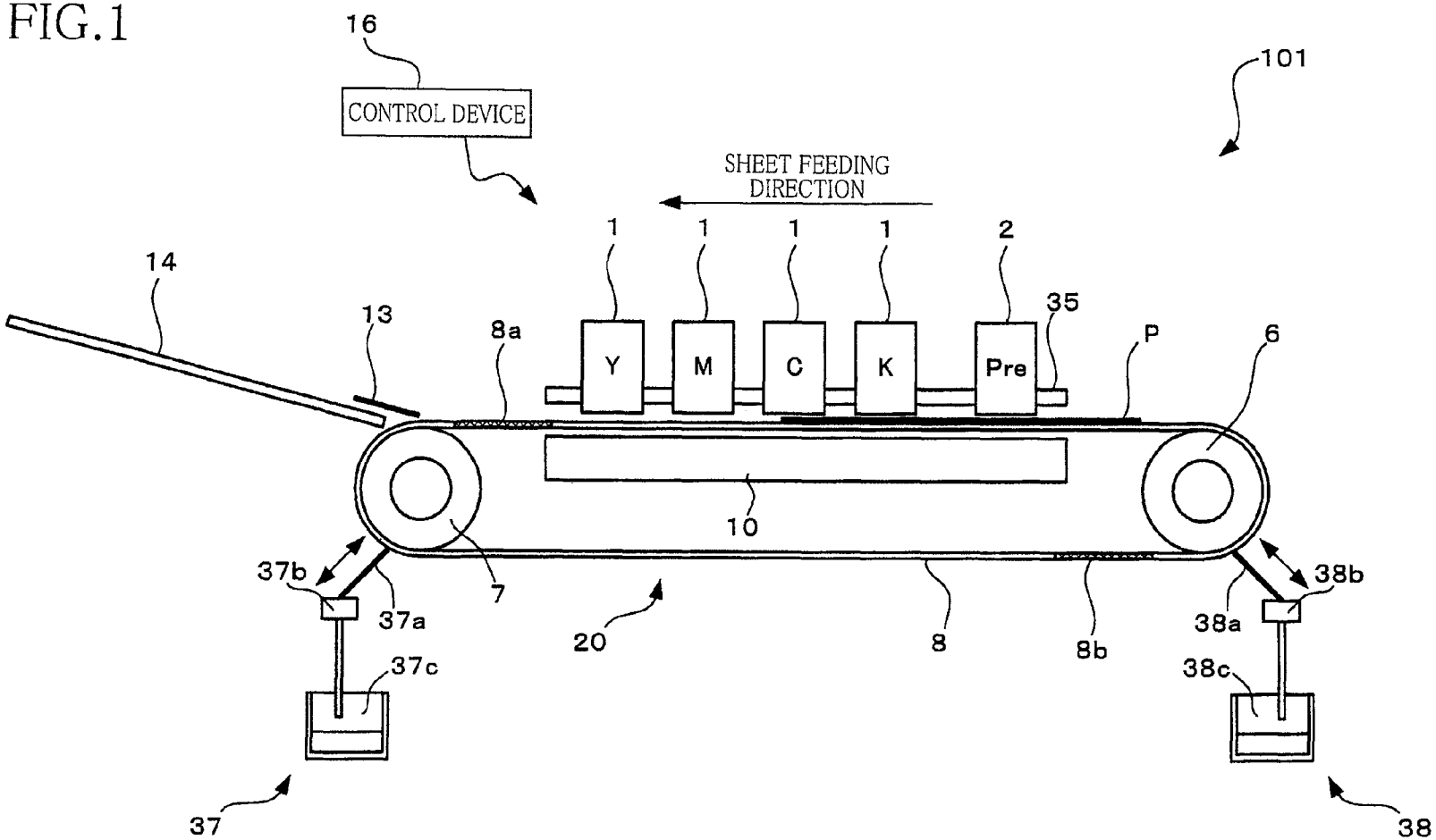
FIG. 1 is a schematic side elevational view of an ink-jet printer constructed according to a first embodiment of this invention.

Referring first to the schematic side elevational view of FIG. 1, there is shown an ink-jet printer 101 constructed as a liquid ejecting apparatus according to a first embodiment of the present invention. The ink-jet printer 101 includes: a medium transfer mechanism in the form of a sheet transfer unit 20 configured to feed a recording medium in the form of a sheet of paper P in a leftward direction as seen in FIG. 1; first-liquid ejecting heads in the form of four ink-jet heads 2 configured to eject droplets of first liquids in the form of black (K), cyan (C), magenta (MA) and yellow (Y) inks onto the paper sheet P being fed by the sheet transfer unit 20; a second-liquid ejecting head in the form of a pre-coating head 2 disposed upstream of the four ink-jet heads 1 as viewed in a feeding direction of the paper sheet P and configured to eject droplets of a second liquid in the form of a pre-coating liquid (Pre) for causing aggregation (cohesion) or deposition (precipitation) of chromogenic components of the four kinds of inks, on the paper sheet P; four ink pumps 32 (shown in FIG. 4) connected to the respective four ink-jet heads 1; a pre-coating pump 33 (shown in FIG. 4) connected to the pre-coating head 2; a head elevator mechanism 34 (shown in FIG. 4); a first cleaning mechanism in the form of an ink cleaner 37; a second cleaning mechanism in the form of a pre-coat cleaner 38; and a control device 16 for controlling the ink-jet printer 101. The direction of feeding of the paper sheet P by the sheet transfer unit 20 is parallel to a secondary scanning direction, which is perpendicular to a primary scanning direction. The primary and secondary scanning directions are parallel to a horizontal plane. Where the pigment inks are used, the pre-coating liquid causes aggregation or cohesion of the chromogenic components of the pigments. Where the dye inks are used, the pre-coating liquid causes deposition or precipitation of the chromogenic components of the dyes.

The sheet transfer unit 20 includes two belt rollers 6 and 7, and an endless sheet conveyor belt 8 connecting the two belt rollers 6 and 7. The belt roller 7 is a driving roller driven by a sheet transfer motor (not shown), while the belt roller 6 is a driven or idler roller driven by the sheet conveyor belt 8 rotated by the belt roller 7. The sheet conveyor belt 8 has an outer circumferential surface covered by a silicone layer having a relatively low degree of adhesiveness for effectively holding the paper sheet P placed on the outer circumferential surface. The paper sheet P placed on this outer circumferential surface of the sheet conveyor belt 8 is fed in the leftward direction as seen in FIG. 1. On the downstream side of the four ink-jet heads 1 as seen in the feeding direction of the paper sheet P, there is disposed a sheet separator plate 13, which functions to separate the paper sheet P from the outer circumferential surface (sheet holding or feeding surface) of the sheet conveyor belt 8, so as to be fed onto a sheet receiver tray 14 disposed downstream of the sheet conveyor belt 8 (sheet separator plate 13), after the paper sheet P is fed past and under the pre-coating head 2 and the four ink-jet heads 1 in this order of description. A platen 10 is disposed within a loop of the sheet conveyor belt 8, in opposition to the four ink-jet heads 1 and the pre-coating head 2, to support an upper span of the loop of the sheet conveyor belt 8, on an inner circumferential surface of the sheet conveyor belt 8, such that there is maintained a suitable amount of gap between the outer circumferential surface of the sheet conveyor belt 8, and ink-ejecting surfaces of the four ink-jet heads 1 and a liquid-ejecting surface of the pre-coating head 2.

The sheet conveyor belt 8 has a rectangular ink-receiving area 8*a* and a rectangular liquid-receiving area 8*b* located at respective circumferential positions thereof. These rectangular ink-receiving and liquid-receiving areas 8*a*, 8*b* extend over the entire width dimension of the sheet conveyor belt 8, and have respective liquid repellent layers on their surfaces. During a maintenance operation of the ink-jet printer 101 described below in detail, the inks are ejected from the ink-jet heads 1 onto the ink-receiving area 8*a*, while the pre-coating liquid is ejected from the pre-coating head 1 onto the liquid-receiving area 8*b*.

Figure 3:
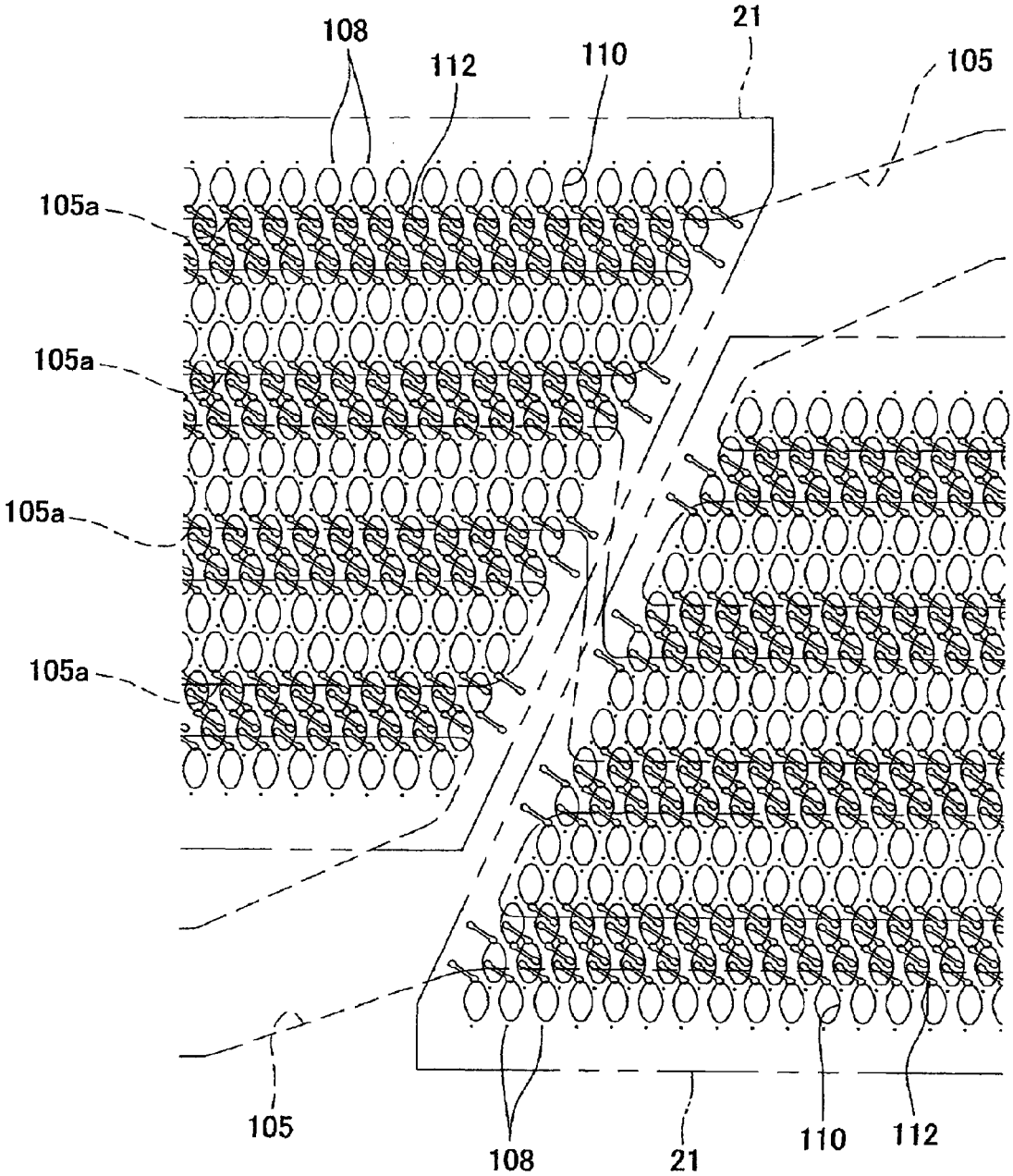
FIG. 3 is an enlarged view of an area enclosed by a one-dot chain line in FIG. 2.

Each of the four ink-jet heads 1 and the pre-coating head 2 have the same structure, and extend in the main scanning direction. The ink-jet heads 1 and pre-coating head 2 are arranged in a spaced-apart relationship with each other in the secondary scanning direction such that the four ink-jet heads 1 and pre-coating head 2 are parallel to each other. Each of the ink-ejecting surfaces of the ink-jet heads 1 has a plurality of first ejecting nozzles in the form of ink-ejecting nozzles 108, while the liquid-ejecting surface of the pre-coating head 2 has a plurality of second ejecting nozzles in the form of liquid-ejecting nozzles, as shown in FIG. 3. Namely, the ink-jet printer 101 is a color ink-jet printer of a line printing type wherein the ink-ejecting nozzles 108 and the liquid-ejecting nozzles are arranged in the main scanning direction.

The outer surface of the upper span of the loop of the sheet conveyor belt 8 and the ink-ejecting and liquid-ejecting surfaces of the heads 1, 2 are parallel and opposed to each other. During a printing operation of the ink-jet printer 101, the pre-coating liquid is ejected from the pre-coating head 2 to coat a printing area of the upper surface of the paper sheet P with the ejected pre-coating liquid while the paper sheet P is fed by the sheet conveyor belt 8 right under the pre-coating head 2, and the inks of the four different colors are successively ejected from the respective four ink-jet heads 1 onto the printing area of the paper sheet P coated with the pre-coating liquid while the printing area is fed right under the ink-jet heads 1, whereby a color image is formed in the printing area of the paper sheet P. When the ink droplets are deposited on a pre-coating layer of the pre-coating liquid on the paper sheet P, the pre-coating liquid causes aggregation (cohesion) or deposition (precipitation) of the chromogenic components of the inks, to prevent blotting of the ink dots on the paper sheet P and improve the coloring effects of the inks.

Figure 2:
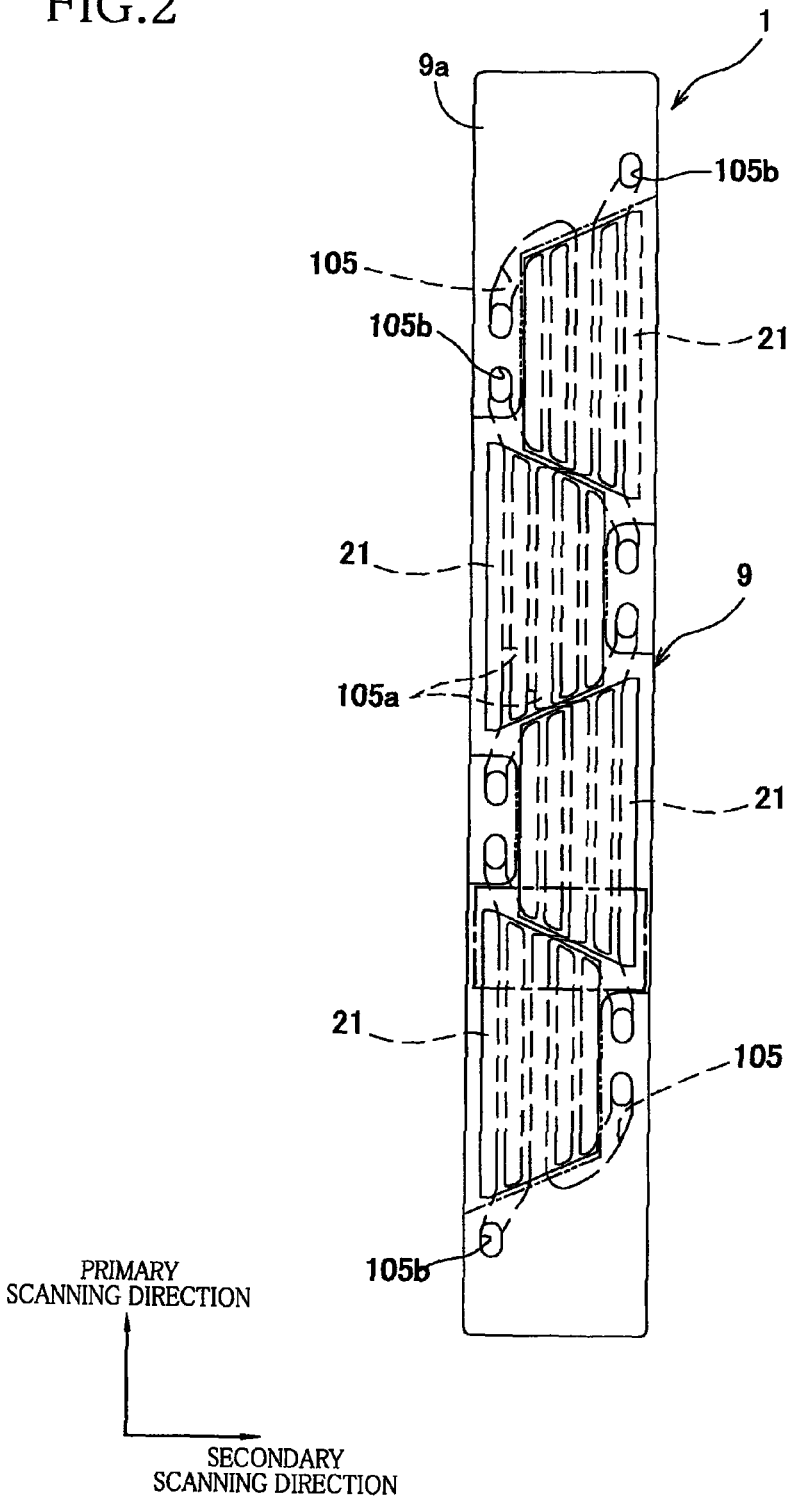
FIG. 2 is a plan view of a main body of an ink-jet head of the ink-jet printer of FIG. 1.

Referring next to FIGS. 2 and 3, there will be described the structure of each ink-jet head 1. As described above, the pre-coating head 2 has the same structure as each ink-jet head 1, and will not be described redundantly. For easier understanding of the structure of the ink-jet head 1, pressure chambers 110, apertures 112 and the ink-ejecting nozzles 108 which are disposed below four actuator units 21 and should be indicated by broken lines are indicated by solid lines in FIG. 3.

As shown in FIG. 2, the ink-jet head 1 is a laminar structure including a passage unit 9 having an upper surface 9*a* on which the above-indicated four actuator units 21 are fixed. As also shown in FIG. 3, the passage unit 9 has ink passages and the above-indicated pressure chambers 110. Each of the actuator units 21 includes a multiplicity of actuators corresponding to the pressure chambers 110, and function to give ink ejecting energies to the masses of the ink in the selected one of the pressure chambers 110, for ejecting the ink droplets from the corresponding ones of the ink-ejecting nozzles 108.

The passage unit 9 is a laminar structure consisting of a plurality of metallic sheets such as stainless steel sheets superposed on each other and positioned relative to each other. The passage unit 9 has main manifold passages 105, auxiliary manifold passages 105*a* communicating with the main manifold passages 105, and a multiplicity of individual ink passages extending from respective outlets of the auxiliary manifold passages 105*a* to the respective ink-ejecting nozzles 108 through the respective ink chambers 110.

In the upper surface 9*a* of the passage unit 9, there are open a total of ten supply ports 105*b* to which the ink is supplied from a reservoir unit (not shown). The passage unit 9 has the lower ink-ejecting surface in which the ink-ejecting nozzles 108 are open such that the nozzles 108 are arranged in a matrix such that the ink-ejecting nozzles 108 are spaced apart from each other in the main scanning direction at a pitch corresponding to the image resolution of 600 dpi in the main scanning direction.

Figure 4:
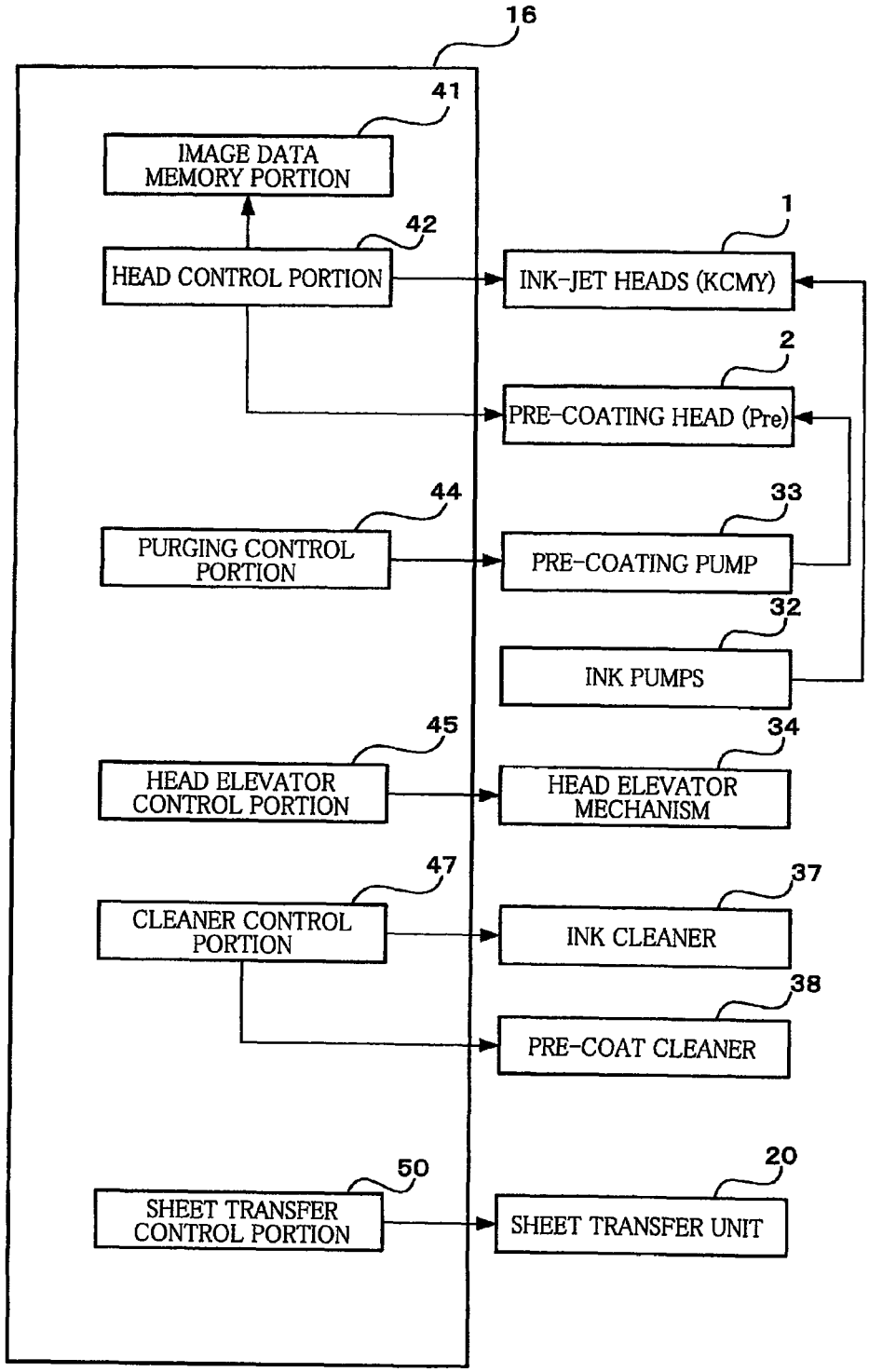
FIG. 4 is a functional block diagram indicating functions of a control device shown in FIG. 1.

Flows of the ink through the passage unit 9 will then be described by reference to FIGS. 3 and 4. The ink introduced into the passage unit 9 from the reservoir unit through the supply ports 105*b* is distributed from each of the main manifold passages 105 into the auxiliary manifold passages 105*a*. The ink flows from each auxiliary manifold passages 105*a* into the individual ink passages and further flows to the ink-ejecting nozzles 108 through the respective pressure chambers 110.

The ink pump 32 connected to the corresponding ink-jet head 1 is operated to positively feed the ink to the supply ports 105*b* of the passage unit 9 through the reservoir unit so that the ink is ejected or discharged from the ink-ejecting nozzles 108. As described above, the four ink pumps 32 (shown in FIG. 4) are provided for the respective four ink-jet heads 1.

The pre-coating pump 33 connected to the pre-coating head 2 is operated to positively feed the pre-coating liquid to the supply ports 105*b* of the passage unit 9 of the pre-coating head 2 through the reservoir unit so that the pre-coating liquid is ejected from the liquid-ejecting nozzles.

Referring back to FIG. 1, the four ink-jet heads 1 and the pre-coating head 2 are fixed to a frame 35 of the ink-jet printer 101. The head elevator mechanism 34 previously indicated is operated by a drive motor (not shown) to move up and down the four ink-jet heads 1 and the pre-coating head 2 together with the frame 35 in the vertical direction.

The ink cleaner 37 also previously indicated is operated during the maintenance operation (described below) of the printer 101, to clean the ink-receiving area 8*a* on which the ink has been ejected from the ink-jet heads 2. The ink cleaner 37 includes a first removing member in the form of a blade 37*a*, an ink receiver 37*b* and a first storing portion in the form of a waste-ink reservoir 37*c*. The blade 37*a* is a planar member formed of an elastic material such as a rubber material and located at a position which is on the left side and downwards (as seen in FIG. 1) of the center of the driving belt roller 7 located downstream of the four ink-jet heads 1 in the feeding direction of the paper sheet P. The blade 37*a* extends in the main scanning direction over the entire width dimension of the sheet conveyor belt 8, in opposition to the outer circumferential surface of the sheet conveyor belt 8. The blade 37*a* is movable by a blade moving mechanism (not shown) to a selected one of its operating or cleaning position of FIGS. 1 and 5 in which the blade 37*a* is held in contact with the outer circumferential surface of the sheet conveyor belt 8; and its retracted position of FIG. 6 in which the blade 37*a* is spaced apart from the outer circumferential surface. The blade 37*a* placed in its operating position scrapes off the ink from the ink-receiving area 8*a* as the ink-receiving area 8*a* is moved downwards along a part of the circumference of the driving belt roller 7, that is, along an outwardly convex part of the sheet conveyor belt 8, during a rotary motion of the sheet conveyor belt 8 in the feeding direction of the paper sheet P. The ink receiver 37*b* receives the ink removed by the blade 37*a* from the ink-receiving area 8*a*, and guides the received ink so as to be accommodated in the waste-ink reservoir 37*c*.

The pre-coat cleaner 38 also previously indicated is operated during the maintenance operation of the printer 101, to clean the liquid-receiving area 8*b* on which the pre-coating liquid has been ejected or discharged from the pre-coating head 1. The pre-coat cleaner 38 includes a second removing member in the form of a blade 38*a*, a pre-coating-liquid receiver 38*b* and a second storing portion in the form of a waste-liquid reservoir 38*c*. The blade 38*a* is a planar member formed of an elastic material such as a rubber material and located at a position which is on the right side and downwards (as seen in FIG. 1) of the center of the driven belt roller 6 located upstream of the pre-coating head 2 in the feeding direction of the paper sheet P. The blade 38*a* extends in the main scanning direction over the entire width dimension of the sheet conveyor belt 8, in opposition to the outer circumferential surface of the sheet conveyor belt 8. The blade 38*a* is movable by a blade moving mechanism (not shown) to a selected one of its operating or cleaning position of FIGS. 1 and 5 in which the blade 38*a* is held in contact with the outer circumferential surface of the sheet conveyor belt 8; and its retracted position of FIG. 6 in which the blade 38*a* is spaced apart from the outer circumferential surface. The blade 38*a* placed in its operating position scrapes off the pre-coating liquid from the liquid-receiving area 8*b* as the liquid-receiving area 8*b* is moved downwards along a part of the circumference of the driven belt roller 6, that is, along another outwardly convex part of the sheet conveyor belt 8, during a rotary motion of the sheet conveyor belt 8 in a direction opposite to the feeding direction of the paper sheet P. The pre-coating-liquid receiver 38*b* receives the pre-coating liquid removed by the blade 38*a* from the liquid-receiving area 8*b*, and guides the received liquid so as to be accommodated in the waste-liquid reservoir 38*c*.

The control device 16 will be described next by reference to FIG. 4. The control device 16 includes: a CPU (central processing unit); an EEPROM (electrically erasable and programmable read-only memory) storing programs executed by the CPU and data used during execution of the programs, such that the programs and data can be erased and programmed; and a RAM (random-access memory) for temporarily storing data during execution of the programs. Various functional portions of the control device 16 are constituted by the above-indicated hardware and the software stored in the EEPROM. As is apparent from the functional block diagram of FIG. 4, the control device 16 controls the various portions of the ink-jet printer 101, and includes a sheet transfer control portion 50, an image data memory portion 41, a head control portion 42, first- and second-liquid ejection control portions in the form of a purging control portion 44, a head elevator control portion 45 and a cleaner control portion 47. The head elevator control portion 45, cleaner control portion 47 and sheet transfer control portion 50 cooperate to function as a medium transfer and cleaning control portion.

The sheet transfer control portion 50 is configured to control the sheet transfer motor of the sheet transfer unit 20 to control the direction and speed of the rotary motion of the sheet conveyor belt 8. The image data memory portion 41 stores image data according to which an image is to be printed on the paper sheet P.

The head control portion 42 is configured to drive the actuator units 21 of the pre-coating head 2 and the actuator units 21 of the four ink-jet heads 1, according to the image data stored in the image data memory portion 41, to eject the droplets of the pre-coating liquid from the liquid-ejecting nozzles at a predetermined timing, and to eject predetermined volumes of the droplets of the inks from the selected ones of the ink-ejecting nozzles 108 at predetermined timings, so as to print the color image.

The head elevator control portion 45 is configured to control the head elevator mechanism 34, to vertically move the frame 35 for vertically moving the four ink-jet heads 1 and pre-coating head 1 to a selected one of their printing position of FIG. 1 in which the printing operations of the ink-jet heads 1 are performed on the paper sheet P; and their maintenance position of FIGS. 5 and 6 in which the ink-ejecting surfaces of the ink-jet heads 1 and the liquid-ejecting surface of the pre-coating head 2 are spaced apart from the outer circumferential surface of the sheet conveyor belt 8, by a predetermined distance. The maintenance position is located above the printing position, that is, spaced upwards from the printing position away from the outer circumferential surface of the sheet conveyor belt 8.

The purging control portion 44 is configured to control the four ink pumps 32 to eject the ink from the ink-ejecting nozzles 108 of each ink-jet head 1 onto the ink-receiving area 8*a* of the sheet conveyor belt 8, during the maintenance operation. The purging control portion 44 is further configured to control the pre-coating pump 33 to eject the pre-coating liquid from the liquid-ejecting nozzles of the pre-coating head 2 onto the liquid-receiving area 8*b* of the sheet conveyor belt 8, during the maintenance operation.

The cleaner control portion 47 is configured to command the sheet transfer control portion 50 to control the rotary motion of the sheet conveyor belt 8, and to control the blade moving mechanisms to control the positions of the blades 37*a*, 38*a*, so that the ink ejected from the ink-jet heads 1 onto the ink-receiving area 8*a* of the sheet conveyor belt 8 under the control of the purging control portion 44 and the pre-coating liquid ejected from the pre-coating head 2 onto the liquid-receiving area 8*b* of the sheet conveyor belt 8 under the control of the purging control portion 44 are scraped off from the respective ink-receiving and liquid-receiving areas 8*a*, 8*b* by the respective blades 38*a*, 38*b*.

Figure 5A:
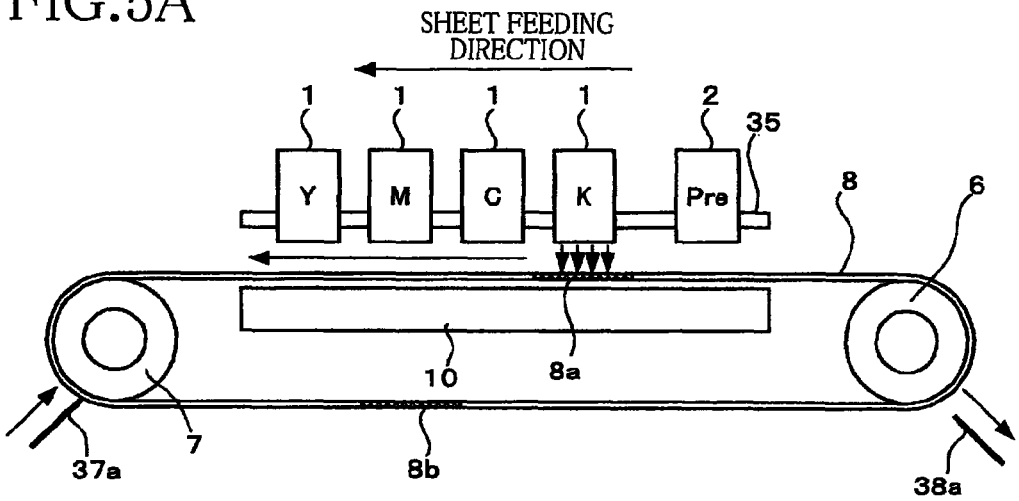
FIGS. 5A-5C are views for explaining a maintenance operation of the ink-jet printer of FIG. 1.
Figure 5B:
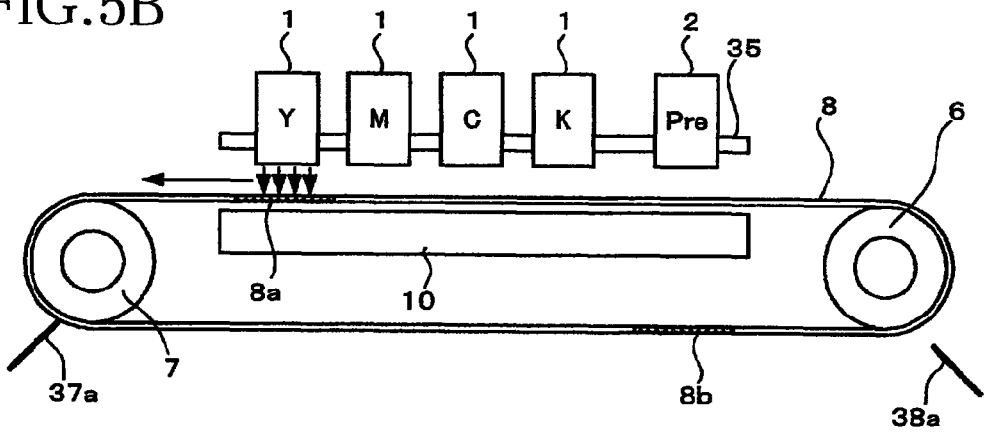

Then, the maintenance operation of the ink-jet printer 101 will be described. The maintenance operation is performed immediately before initiation of the printing operation, or on demand by the user of the ink-jet printer 101. Upon initiation of the maintenance operation, the head elevator control portion 45 controls the head elevator mechanism 34 to vertically move the four ink-jet heads 1 and pre-coating head 2 from the printing position to the maintenance position, as indicated in of FIG. 5A. Further, the cleaner control portion 47 controls the blade moving mechanisms to move the blade 37*a* to the cleaning position and to move the blade 38*a* to the retracted position, and the sheet transfer control portion 50 controls the sheet transfer motor of the sheet transfer unit 20 to rotate the sheet conveyor belt 8 in the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1, as indicated in FIGS. 5A and 5B.

Figure 5C:
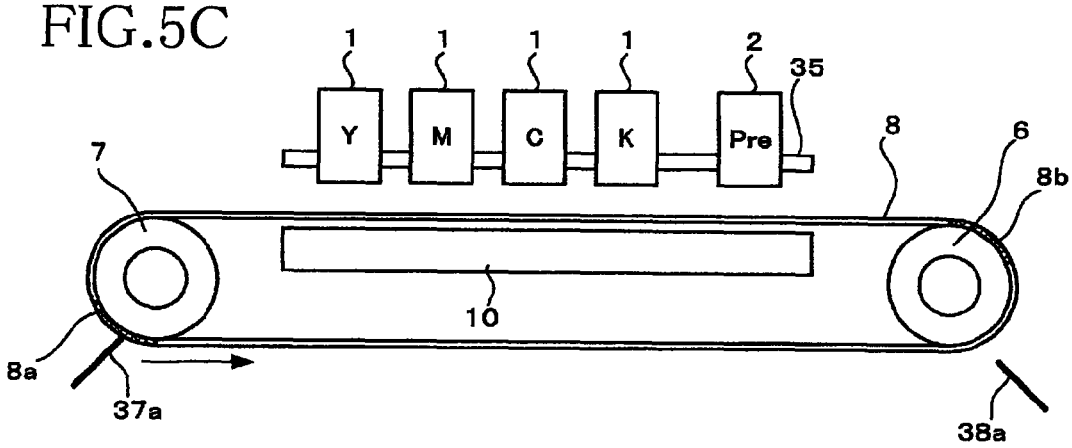

Subsequently, the ink-receiving area 8*a* reaches the position of the blade 37*a* before the ink-receiving area 8*a* reaches the positions of the blade 38*a* and the pre-coating head 2, as indicated in FIG. 5C. The blade 37*a* placed in the cleaning position scrapes off the inks from the ink-receiving area 8*a* as the ink-receiving area 8*a* is moved downwards along the convex part of the sheet conveyor belt 8. At this time, the blade 38*a* is placed in the retracted position in which the blade 38*a* is spaced apart from the sheet transfer belt 8. The inks scraped off from the ink-receiving area 8*a* are received by the ink receiver 37*b* and then accommodated in the waste-ink reservoir 37*c*.

Figure 6A:
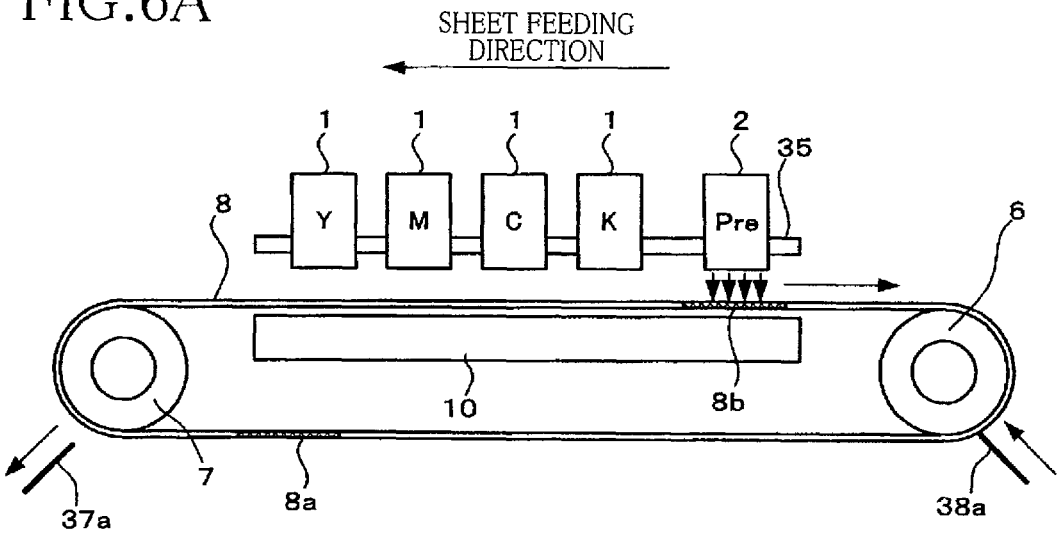
FIGS. 6A and 6B are views for explaining the maintenance operation of the ink-jet printer of FIG. 1.

After the inks ejected onto the ink-receiving area 8*a* have been wholly scraped off by the blade 37*a* from the ink-receiving area 8*a*, the cleaner control portion 47 controls the blade moving mechanisms to move the blade 37*a* to its retracted position and to move blade 38*a* to the cleaning position, as indicated in FIG. 6A, and the sheet transfer control portion 50 controls the sheet transfer motor of the sheet transfer unit 20 to rotate the sheet conveyor belt 8 in the direction opposite to the sheet feeding direction. As the liquid-receiving area 8*b* is moved by the rotary motion of the sheet conveyor belt 8, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2.

Figure 6B:
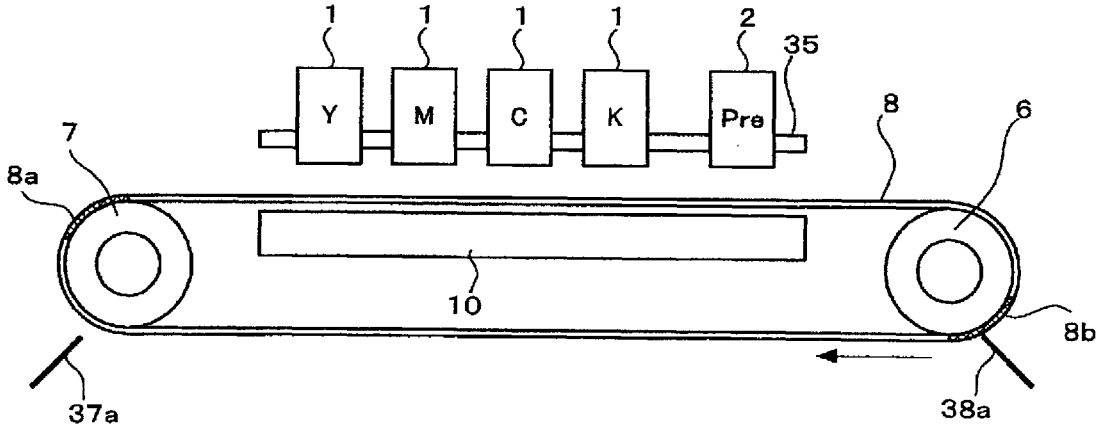

Subsequently, the liquid-receiving area 8*b* reaches the position of the blade 38*a* before the liquid-receiving area 8*b* reaches the positions of the blade 37*a* and the four ink-jet heads 1, as indicated in FIG. 6B. The blade 38*a* placed in the cleaning position scrapes off the pre-coating liquid from the liquid-receiving area 8*b* as the liquid-receiving area 8*b* is moved downwards along the convex part of the sheet conveyor belt 8. At this time, the blade 37*a* is placed in the retracted position in which the blade 37*a* is spaced apart from the sheet transfer belt 8. The pre-coating liquid scraped off from the liquid-receiving area 8*b* is received by the pre-coating-liquid receiver 38*b* and then accommodated in the waste-liquid reservoir 38*c*. After the pre-coating liquid ejected onto the liquid-receiving area 8*b* has been wholly scraped off by the blade 38*a* from the liquid-receiving area 8*b*, the ink-ejecting surfaces of the ink-jet heads 1 and the liquid-ejecting surface of the pre-coating head 1 are wiped by wipers (not shown), and the head elevator control portion 45 controls the head elevator mechanism 34 to vertically move the four ink-jet heads 1 and pre-coating head 2 from the maintenance position back to the printing position. Thus, the maintenance operation is performed.

The ink-jet printer 101 constructed according to the present first embodiment of the invention performs the maintenance operation wherein the inks ejected onto the ink-receiving area 8*a* are scraped off from the in-receiving area 8*a* by the blade 37*a*, without the ink-receiving area 8*a* reaching a position of a part of the conveyor belt 8 to which the blade 38*a* is opposed, and the pre-coating liquid ejected onto the liquid-receiving area 8*b* is scraped off by the blade 38*a*, without the liquid-receiving area 8*b* reaching a position of a part of the conveyor belt 8 to which the blade 37*a* is opposed. Thus, the inks ejected onto the ink-receiving area 8*a* and the pre-coating liquid ejected onto the liquid-receiving area 8*b* do not mix with each other, so that substances which would be produced as a result of aggregation (cohesion) or deposition (precipitation) of the chromogenic components of the inks by the pre-coating liquid do not adhere to the outer circumferential surface of the sheet conveyor belt 8 and the ink cleaner 37 and pre-coat cleaner 38. Accordingly, the maintenance operation does not reduce the capability of the sheet transfer unit 20 to feed the paper sheet P, and the cleaning capability of the ink cleaner 37 and pre-coat cleaner 38.

Further, the maintenance operation is performed such that the inks ejected onto the ink-receiving area 8*a* are scraped off by the blade 37*a*, without opposition of the ink-receiving area 8*a* to the pre-coating head 2, and the pre-coating liquid ejected onto the liquid-receiving area 8*b* is scraped off by the blade 38*a*, without opposition of the liquid-receiving area 8*b* to the four ink-jet heads 1. Thus, the inks ejected from the ink-jet heads 1 do not adhere to the liquid-ejecting nozzles of the pre-coating head 2, and the pre-coating liquid ejected onto the liquid-receiving area 8*b* do not adhere to the ink-ejecting nozzles 108 of the ink-jet heads 1, so that the substances which would be produced as a result of aggregation (cohesion) or deposition (precipitation) of the chromogenic components of the inks by the pre-coating liquid do not adhere to the ink-ejecting nozzles 108 of the ink-jet heads 1 and the liquid-ejecting nozzles of the pre-coating head 2. It is also noted that the ink cleaner 37 and the pre-coat cleaner 38 are disposed on the respective downstream and upstream sides of an array of the ink-jet heads 1 and pre-coating head 2, as seen in the feeding direction of the paper sheet P, so that the set of the ink-jet heads 1 and the pre-coating head 2 can be disposed close to each other, and positioned relative to each other with a high degree of accuracy, and the ink-jet printer 101 can be small-sized.

Furthermore, the inks ejected onto the ink-receiving area 8*a* are received by the ink receiver 37*b* and accommodated in the waste-ink reservoir 37*c*, and the pre-coating liquid ejected onto the liquid-receiving area 8*b* is received by the pre-coating-liquid receiver 38*b* and accommodated in the waste-liquid reservoir 38*c*. Thus, the ejected inks and the ejected pre-coating liquid do not mix with each other in the process of removal and wasting of the inks and pre-coating liquid, so that any substances are not produced within the passages for the removal and wasting of the inks and pre-coating liquid, as a result of aggregation (cohesion) or deposition (precipitation) of the chromogenic components of the inks by the pre-coating liquid.

In addition, the inks ejected the ink-receiving area 8*a* are scraped off from the ink-receiving area 8*a* by the blade 37*a* while the ink-receiving area 8*a* is moved downwards along a part of the circumference of the driving belt roller 7 (along an outwardly convex part of the sheet conveyor belt 8), namely, while a layer of the ejected inks has an outwardly convex form, so that this layer can be easily removed by the blade 37*a*. Similarly, the pre-coating liquid ejected onto the liquid-receiving area 8*b* is scraped off from the liquid-receiving area 8*b* by the blade 38*a* while the liquid-receiving area 8*b* is moved downwards along a part of the circumference of the driven belt roller 6 (along another outwardly convex part of the sheet conveyor belt 8), namely, while a layer of the ejected pre-coating liquid has an outwardly convex form, so that this layer can be easily removed by the blade 38*a*.

Further, the ink-receiving area 8*a* and the liquid-receiving area 8*b* of the sheet conveyor belt 8 are spaced apart from each other in the rotating direction of the sheet conveyor belt 8, so that the substances which would be produced as a result of aggregation (cohesion) or deposition (precipitation) of the chromogenic components of the inks by the pre-coating liquid do not adhere to the outer circumferential surface of the sheet conveyor belt 8.

Second Embodiment

Figure 7A:
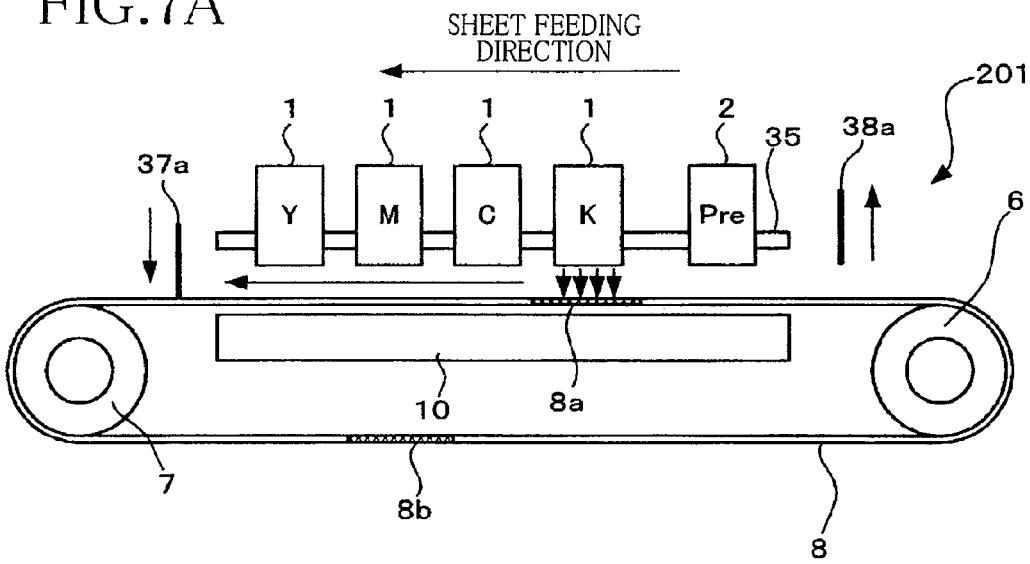
FIGS. 7A and 7B are schematic side elevational views of an ink-jet printer constructed according to a second embodiment of the present invention.

An ink-jet printer 201 constructed according to a second embodiment of this invention will be described. The same reference signs as used in the first embodiment will be used to identify substantially the same elements of the ink-jet printer 201 as those of the ink-jet printer 101 of the first embodiment. As shown in FIG. 7A, the blade 37*a* of the ink cleaner 37 is disposed in opposition to a flat or straight part of the upper span of the loop of the sheet conveyor belt 8, which is downstream of the four ink-jet heads 1 in the feeding direction of the paper sheet P, while the blade 38*a* of the pre-coat cleaner 38 is disposed in opposition to a flat or straight part of the upper span, which is upstream of the pre-coating head 2.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 7B:
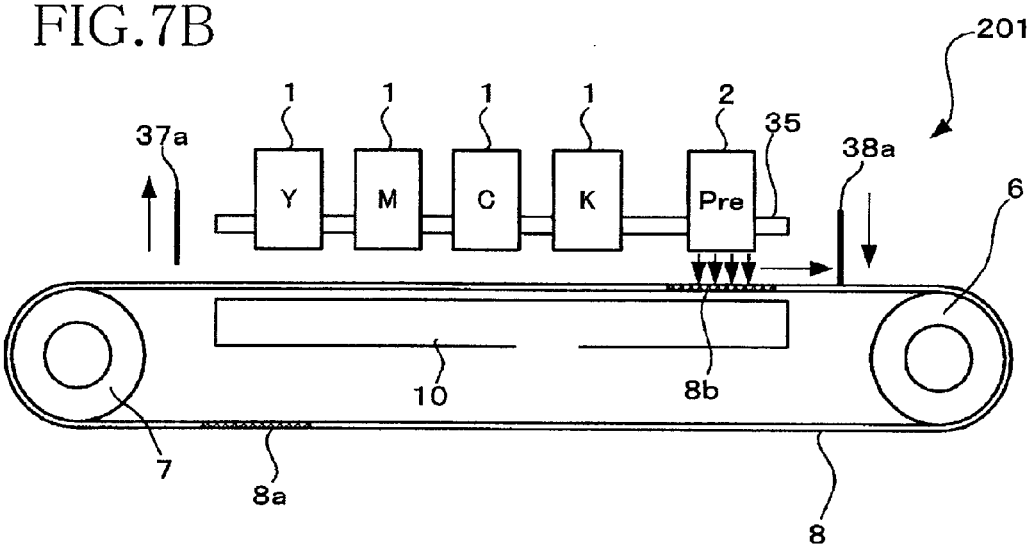

Then, the cleaner control portion 47 controls the blade moving mechanisms to move the blade 37*a* to its retracted position and to move blade 38*a* to the cleaning position, as indicated in FIG. 7B, and the sheet transfer control portion 50 controls the sheet transfer motor of the sheet transfer unit 20 to rotate the sheet conveyor belt 8 in the direction opposite to the sheet feeding direction. As the liquid-receiving area 8*b* is moved by the rotary motion of the sheet conveyor belt 8, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 201 constructed according to the second embodiment of the invention performs the maintenance operation wherein the inks ejected onto the ink-receiving area 8*a* are scraped off from the in-receiving area 8*a* by the blade 37*a*, without the ink-receiving area 8*a* reaching positions of parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching positions of other parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ejected inks and pre-coating liquid are scraped off from the respective ink-receiving area 8*a* and liquid-receiving area 8*b* which are flat or straight extending in the horizontal direction, so that the inks and pre-coating liquid do not fall down from the flat areas 8*a* and 8*b*.

Third Embodiment

Figure 8A:
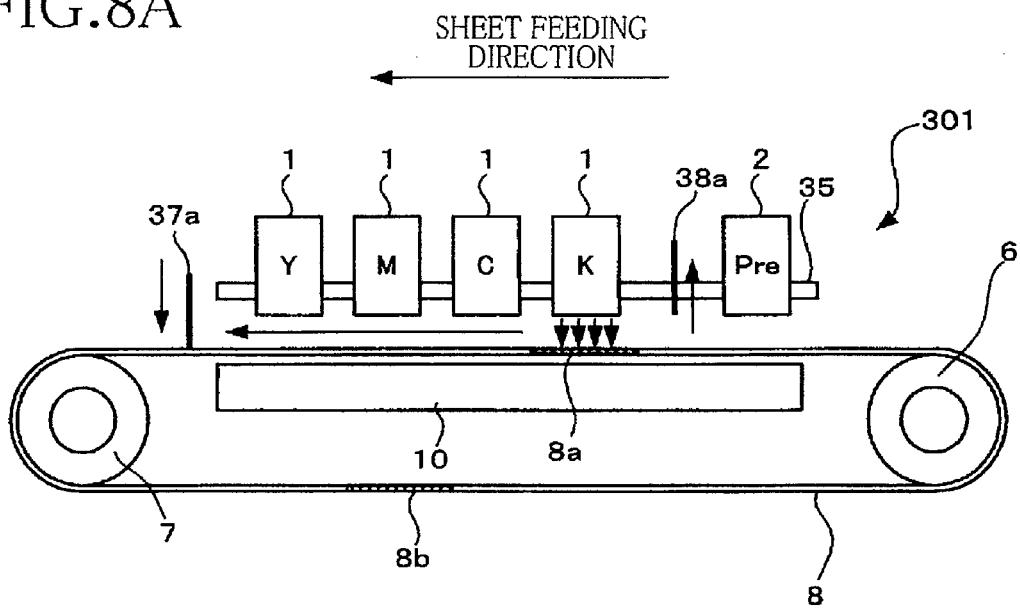
FIGS. 8A and 8B are schematic side elevational views of an ink-jet printer according to a third embodiment of the invention.

An ink-jet printer 301 constructed according to a third embodiment of this invention will be described. The same reference signs as used in the first embodiment will be used to identify substantially the same elements of the ink-jet printer 301 as those of the ink-jet printer 101 of the first embodiment. As shown in FIG. 8A, the blade 37*a* is disposed in opposition to a flat part of the upper span of the loop of the sheet conveyor belt 8, which is downstream of the four ink-jet heads 1 in the feeding direction of the paper sheet P, while the blade 38*a* is disposed in opposition to a flat part of the upper span, which is upstream of the ink-jet heads 1 and downstream of the pre-coating head 2.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 8B:
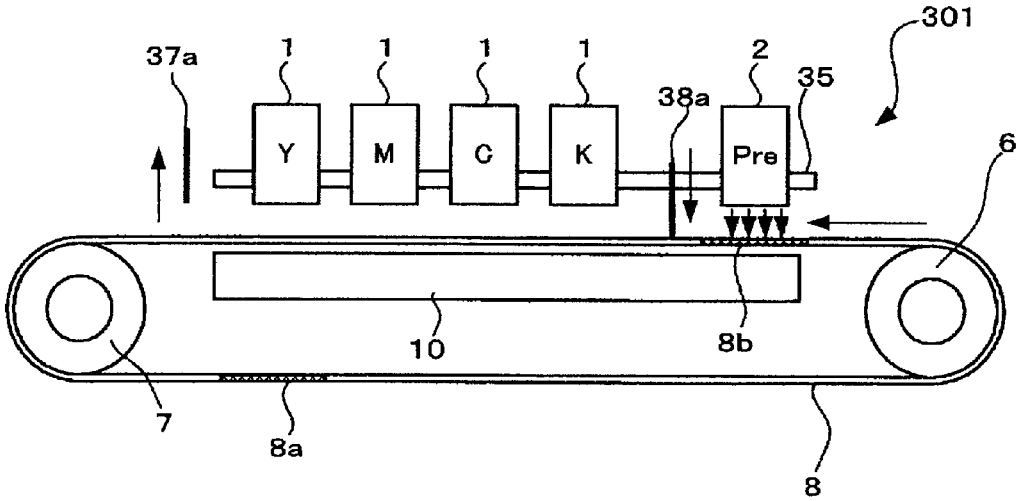

Then, the cleaner control portion 47 controls the blade moving mechanisms to move the blade 37*a* to its retracted position and to move blade 38*a* to the cleaning position, as indicated in FIG. 8B while the sheet conveyor belt 8 is rotated in the sheet feeding direction. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 301 constructed according to the third embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ink-jet printer 301 do not require reversal of the rotating direction of the sheet conveyor belt 8 (feeding direction of the paper sheet P) when the pre-coating liquid is ejected onto and scraped off from the liquid-receiving area 8*b* after the inks are ejected onto and scraped off from the ink-receiving area 8*a*, so that the discharging and scraping operations of the inks and pre-coating liquid can be performed continuously, making it possible to reduce the time required for the maintenance operation.

Fourth Embodiment

Figure 9A:
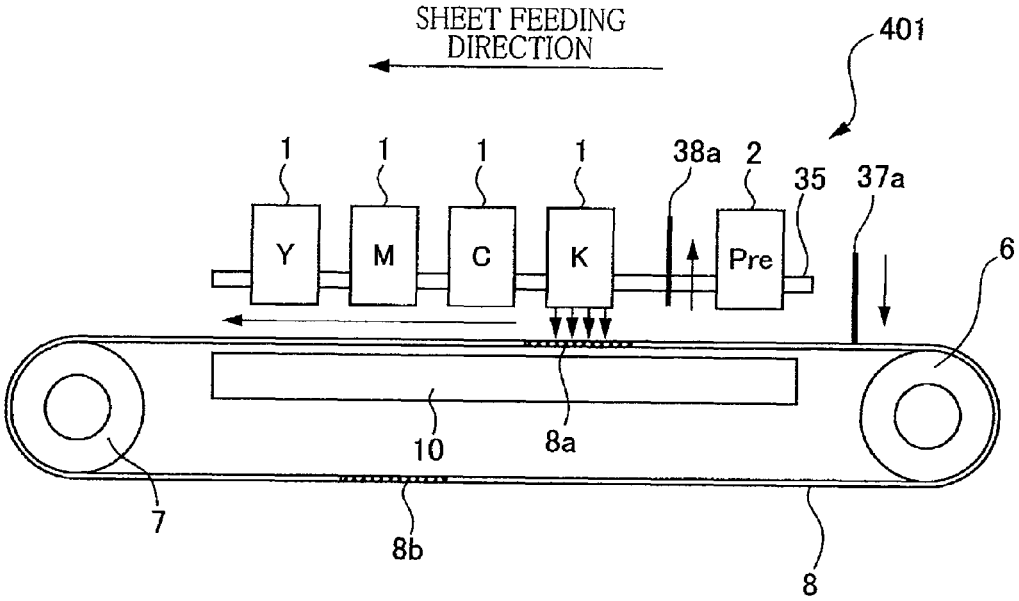

An ink-jet printer 401 constructed according to a fourth embodiment of this invention will be described. The same reference signs as used in the first embodiment will be used to identify substantially the same elements of the ink-jet printer 401 as those of the ink-jet printer 101 of the first embodiment. As shown in FIG. 9A, the blade 37*a* is disposed in opposition to a flat part of the horizontally extending upper span of the loop of the sheet conveyor belt 8, which is upstream of the pre-coating head 2 in the feeding direction of the paper sheet P, while the blade 38*a* is disposed in opposition to a flat part of the upper span, which is upstream of the ink-jet heads 1 and downstream of the pre-coating head 2.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 9B:
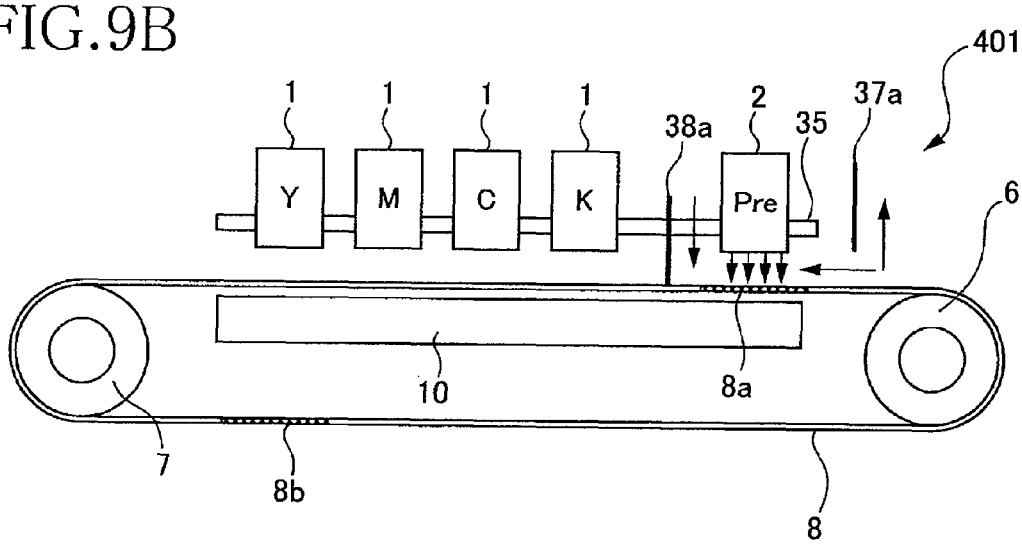

Then, the cleaner control portion 47 controls the blade moving mechanisms to move the blade 37*a* to its retracted position and to move blade 38*a* to the cleaning position while the sheet conveyor belt 8 is rotated in the sheet feeding direction, as indicated in FIG. 9B. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 401 constructed according to the fourth embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 tow which the pre-coating head 2 and blade 38*a* are opposed, and the pre-coating liquid ejected onto the liquid-receiving area 8*b* is scraped off by the blade 38*a*, with the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ink-jet printer 301 do not require reversal of the rotating direction of the sheet conveyor belt 8 (feeding direction of the paper sheet P) when the pre-coating liquid is ejected onto and scraped off from the liquid-receiving area 8*b* after the inks are ejected onto and scraped off from the ink-receiving area 8*a*, so that the discharging and scraping operations of the inks and pre-coating liquid can be performed continuously, making it possible to reduce the time required for the maintenance operation.

Fifth Embodiment

Figure 10A:
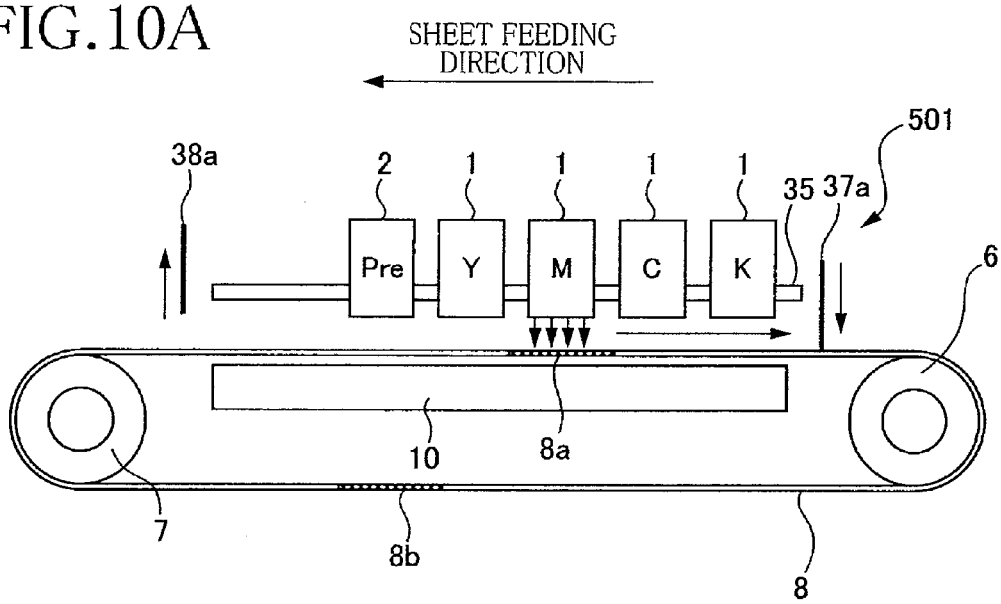

An ink-jet printer 501 constructed according to a fifth embodiment of this invention will be described. The same reference signs as used in the first embodiment will be used to identify substantially the same elements of the ink-jet printer 501 as those of the ink-jet printer 101 of the first embodiment. As shown in FIG. 10A, the pre-coating head 2 is disposed downstream of the ink-jet heads 1 the feeding direction of the paper sheet P, and the blade 37*a* is disposed in opposition to a flat part of the upper span of the loop of the sheet conveyor belt 8, which is upstream of the ink-jet heads 1, while the blade 38*a* is disposed in opposition to a flat part of the upper span, which is downstream of the pre-coating head 2.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the direction opposite to the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 10B:
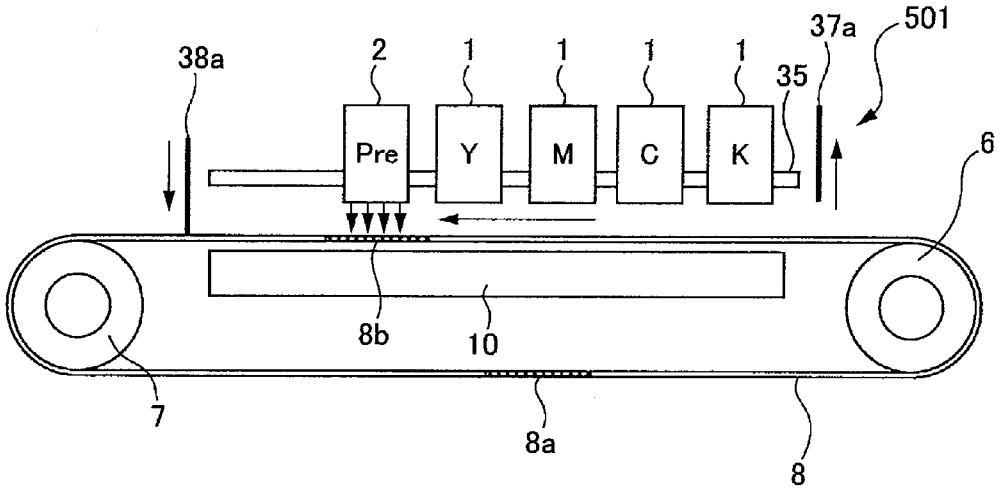

Then, the cleaner control portion 47 controls the blade moving mechanisms to move the blade 37*a* to its retracted position and to move blade 38*a* to the cleaning position while the sheet conveyor belt 8 is further rotated in the direction opposite to the sheet feeding direction, as indicated in FIG. 10B. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 501 constructed according to the fifth embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Sixth Embodiment

Figure 11A:
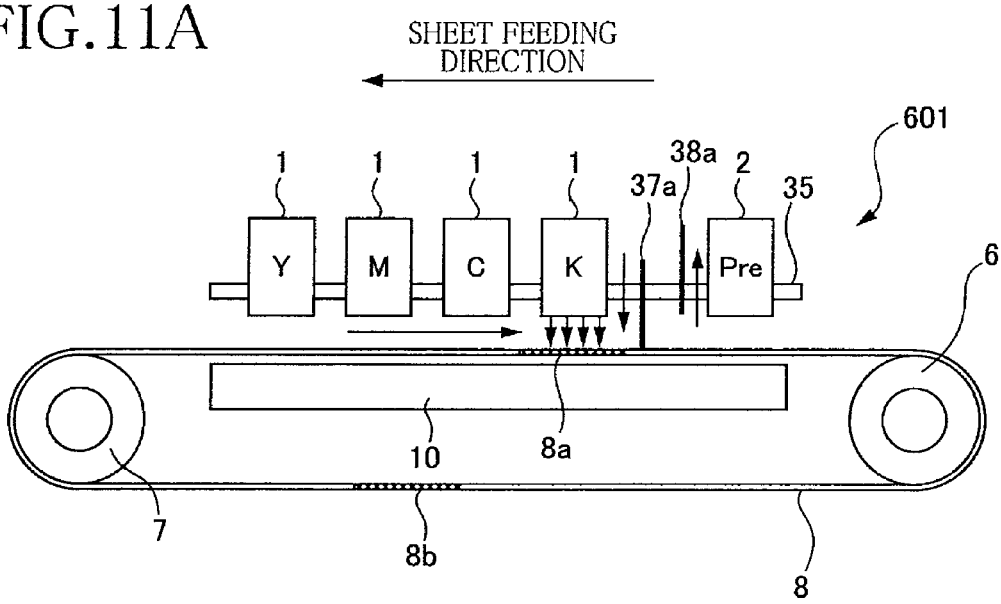

An ink-jet printer 601 constructed according to a sixth embodiment of this invention will be described. The same reference signs as used in the first embodiment will be used to identify substantially the same elements of the ink-jet printer 601 as those of the ink-jet printer 101 of the first embodiment. As shown in FIG. 11A, the pre-coating head 2 is disposed upstream of the ink-jet heads 1 in the feeding direction of the paper sheet P, and the blades 37*a* and 38*a* are disposed in opposition to flat parts of the upper span of the loop of the sheet conveyor belt 8, which are intermediate between the pre-coating head 2 and the ink-jet heads 1, such that the blade 37*a* is disposed downstream of the blade 38*a*.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the direction opposite to the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 11B:
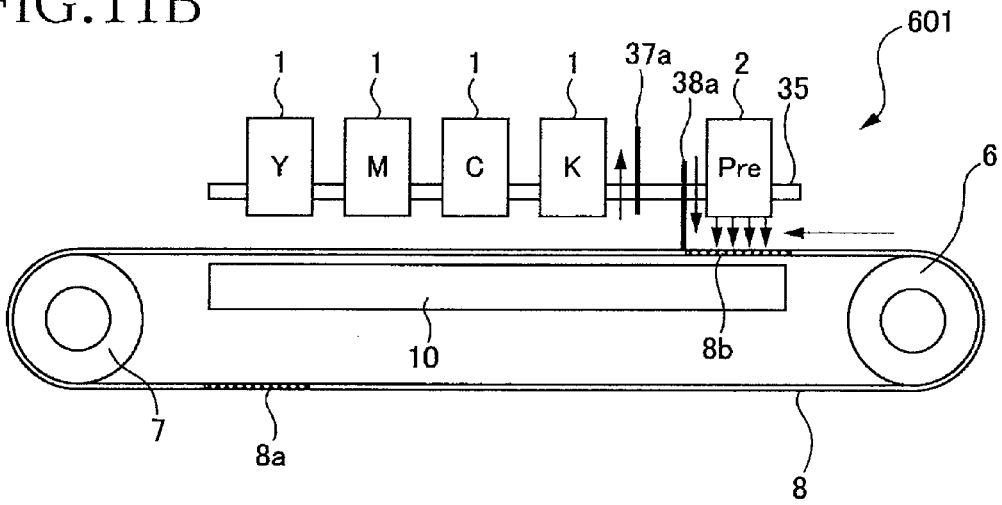

Then, the cleaner control portion 47 controls the blade moving mechanisms to move the blade 37*a* to its retracted position and to move blade 38*a* to the cleaning position, as indicated in FIG. 11B, and the sheet transfer control portion 50 controls the sheet transfer motor of the sheet transfer unit 20 to rotate the sheet conveyor belt 8 in the sheet feeding direction. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 601 constructed according to the sixth embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Seventh Embodiment

Figure 12A:
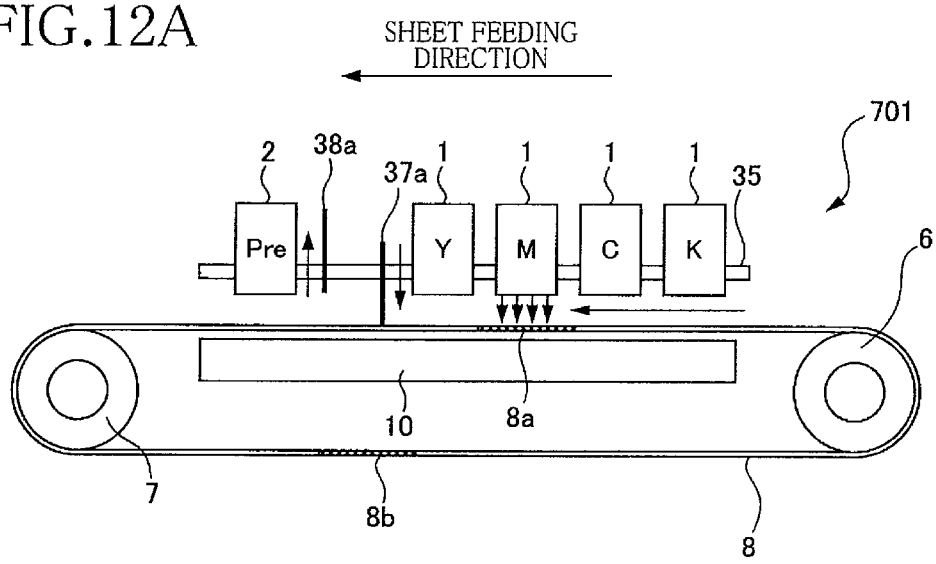

An ink-jet printer 701 constructed according to a seventh embodiment of this invention will be described. The same reference signs as used in the first embodiment will be used to identify substantially the same elements of the ink-jet printer 701 as those of the ink-jet printer 101 of the first embodiment. As shown in FIG. 12A, the pre-coating head 2 is disposed downstream of the ink-jet heads 1 in the feeding direction of the paper sheet P, and the blades 37*a* and 38*a* are disposed in opposition to flat parts of the upper span of the loop of the sheet conveyor belt 8, which are intermediate between the pre-coating head 2 and the ink-jet heads 1, such that the blade 37*a* is disposed upstream of the blade 38*a*.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 12B:
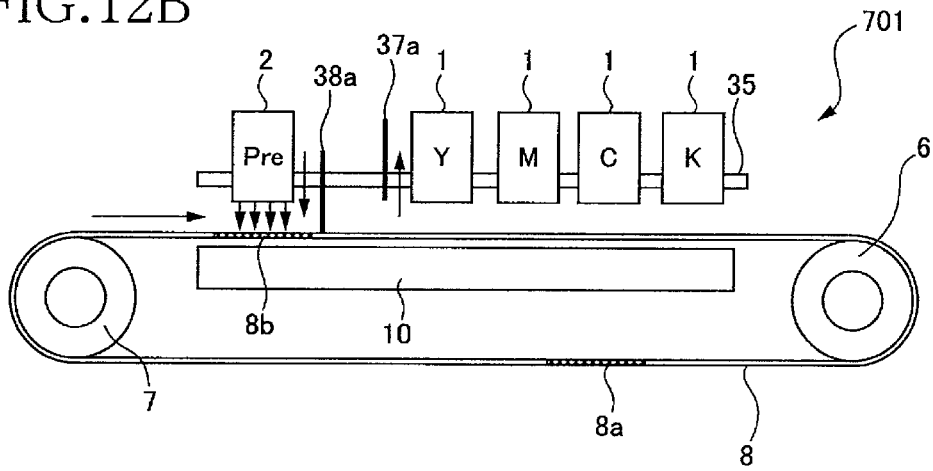

Then, the cleaner control portion 47 controls the blade moving mechanisms to move the blade 37*a* to its retracted position and to move blade 38*a* to the cleaning position, as indicated in FIG. 12B, and the sheet transfer control portion 50 controls the sheet transfer motor of the sheet transfer unit 20 to rotate the sheet conveyor belt 8 in the direction opposite to the sheet feeding direction. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 701 constructed according to the seventh embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Eighth Embodiment

Figure 13A:
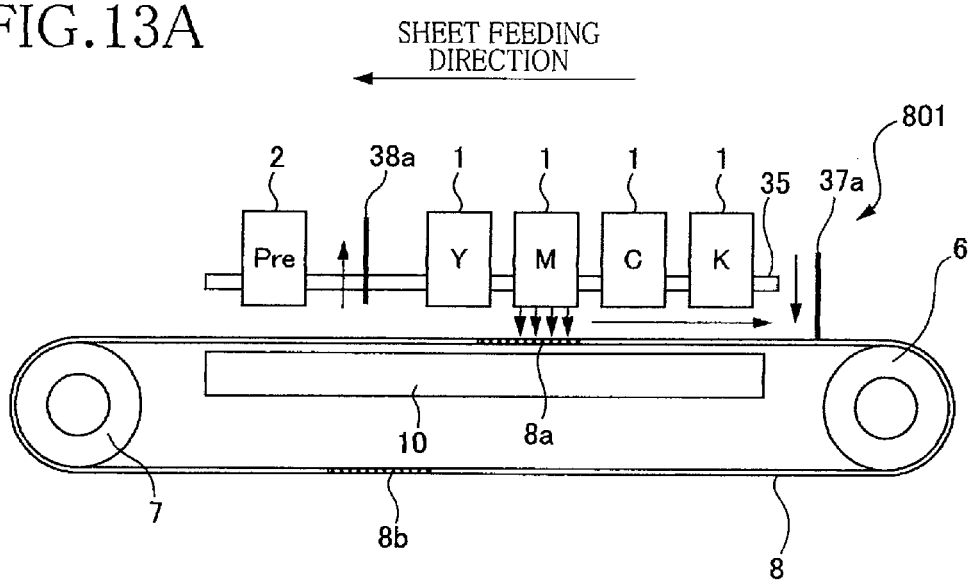

An ink-jet printer 801 constructed according to an eighth embodiment of this invention will be described. The same reference signs as used in the first embodiment will be used to identify substantially the same elements of the ink-jet printer 801 as those of the ink-jet printer 101 of the first embodiment. As shown in FIG. 13A, the pre-coating head 2 is disposed downstream of the ink-jet heads 1 in the feeding direction of the paper sheet P, and the blade 37*a* is disposed in opposition to a flat part of the upper span of the loop of the sheet conveyor belt 8, which is upstream of the ink-jet heads 1, while the blade 38*a* is disposed in opposition to a flat part of the upper span, which is downstream of the ink-jet heads 1 and upstream of the pre-coating head 2.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the direction opposite to the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 13B:
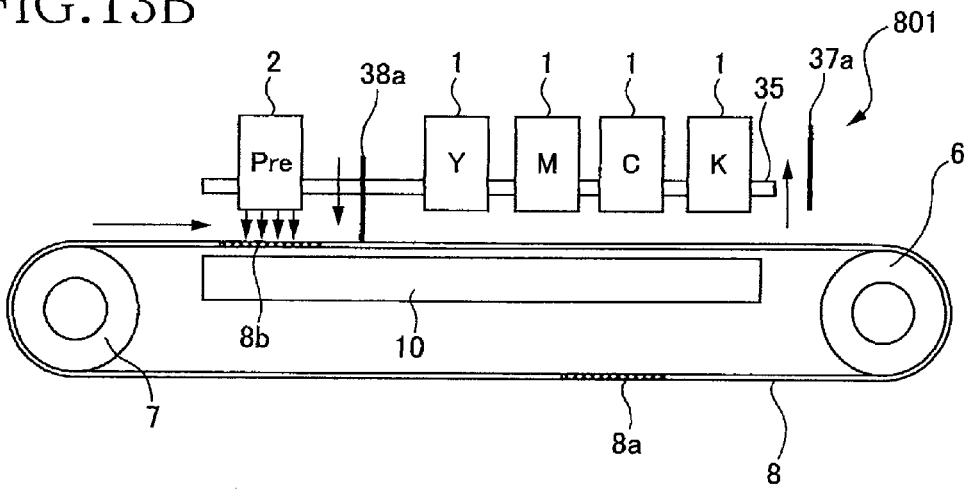

Then, the cleaner control portion 47 controls the blade moving mechanisms to move the blade 37*a* to its retracted position and to move blade 38*a* to the cleaning position while the sheet conveyor belt 8 is further rotated in the direction opposite to the sheet feeding direction, as indicated in FIG. 13B. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 801 constructed according to the eighth embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ink-jet printer 801 do not require reversal of the rotating direction of the sheet conveyor belt 8 (feeding direction of the paper sheet P) when the pre-coating liquid is ejected onto and scraped off from the liquid-receiving area 8*b* after the inks are ejected onto and scraped off from the ink-receiving area 8*a*, so that the discharging and scraping operations of the inks and pre-coating liquid can be performed continuously, making it possible to reduce the time required for the maintenance operation.

Ninth Embodiment

Figure 14A:
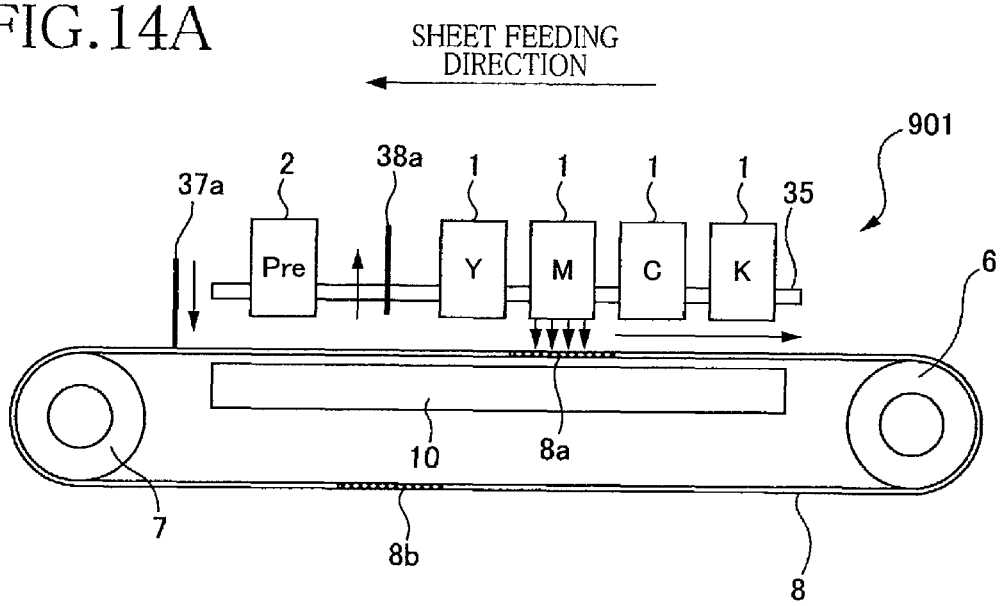

An ink-jet printer 901 constructed according to a ninth embodiment of this invention will be described. The same reference signs as used in the first embodiment will be used to identify substantially the same elements of the ink-jet printer 901 as those of the ink-jet printer 101 of the first embodiment. As shown in FIG. 14A, the pre-coating head 2 is disposed downstream of the ink-jet heads 2 in the feeding direction of the paper sheet P, and the blade 37*a* is disposed in opposition to a flat part of the upper span of the loop of the sheet conveyor belt 8, which is downstream of the pre-coating head 2, while the blade 38*a* is disposed in opposition to a flat part of the upper span, which is downstream of the ink-jet heads 1 and upstream of the pre-coating head 2.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the direction opposite to the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 14B:
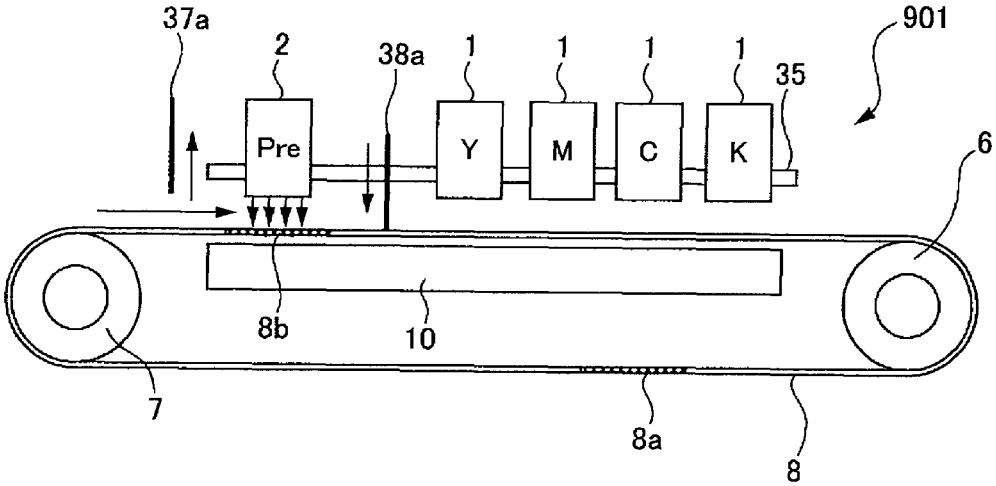

Then, the cleaner control portion 47 controls the blade moving mechanisms to move the blade 37*a* to its retracted position and to move blade 38*a* to the cleaning position while the sheet conveyor belt 8 is further rotated in the direction opposite to the sheet feeding direction, as indicated in FIG. 14B. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 901 constructed according to the ninth embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ink-jet printer 901 do not require reversal of the rotating direction of the sheet conveyor belt 8 (feeding direction of the paper sheet P) when the pre-coating liquid is ejected onto and scraped off from the liquid-receiving area 8*b* after the inks are ejected onto and scraped off from the ink-receiving area 8*a*, so that the discharging and scraping operations of the inks and pre-coating liquid can be performed continuously, making it possible to reduce the time required for the maintenance operation.

Tenth Embodiment

Figure 15A:
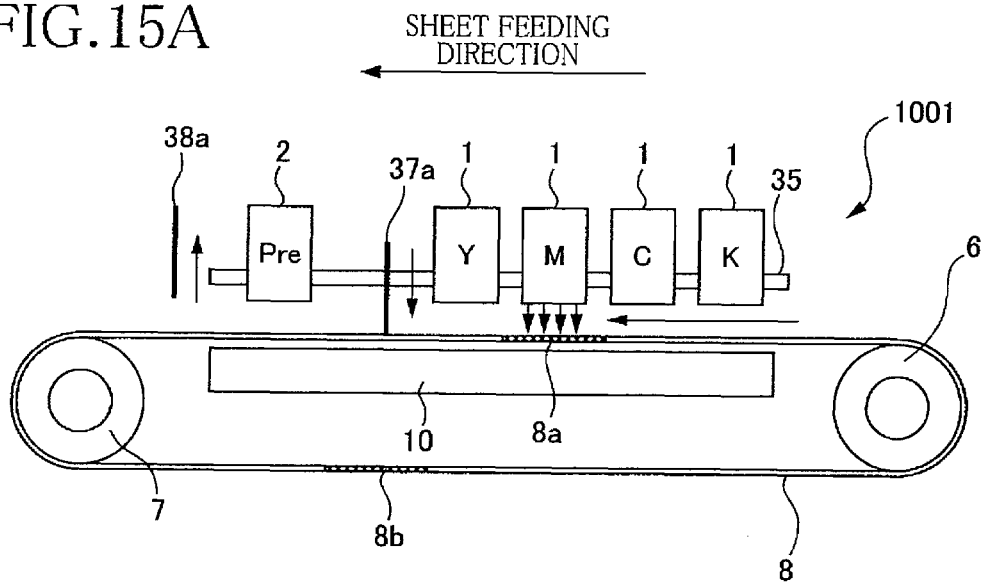
Figure 15B:
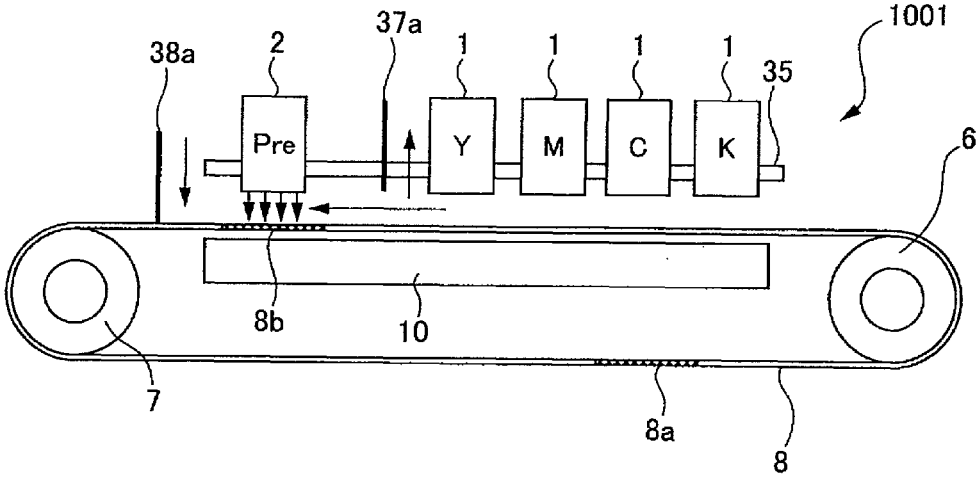

An ink-jet printer 1001 constructed according to a tenth embodiment of this invention will be described. The same reference signs as used in the first embodiment will be used to identify substantially the same elements of the ink-jet printer 1001 as those of the ink-jet printer 101 of the first embodiment. As shown in FIG. 15A, the pre-coating head 2 is disposed downstream of the ink-jet heads 2 in the feeding direction of the paper sheet P, and the blade 37*a* is disposed in opposition to a flat part of the upper span of the loop of the sheet conveyor belt 8, which is downstream of the ink-jet heads 1 and upstream of the pre-coating head 2, while the blade 38*a* is disposed in opposition to a flat part of the upper span, which is downstream of the pre-coating head 2.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Then, the cleaner control portion 47 controls the blade moving mechanisms to move the blade 37*a* to its retracted position and to move blade 38*a* to the cleaning position while the sheet conveyor belt 8 is further rotated in the sheet feeding direction, as indicated in FIG. 14B. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 1001 constructed according to the tenth embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ink-jet printer 1001 do not require reversal of the rotating direction of the sheet conveyor belt 8 (feeding direction of the paper sheet P) when the pre-coating liquid is ejected onto and scraped off from the liquid-receiving area 8*b* after the inks are ejected onto and scraped off from the ink-receiving area 8*a*, so that the discharging and scraping operations of the inks and pre-coating liquid can be performed continuously, making it possible to reduce the time required for the maintenance operation.

Eleventh Embodiment

Figure 16A:
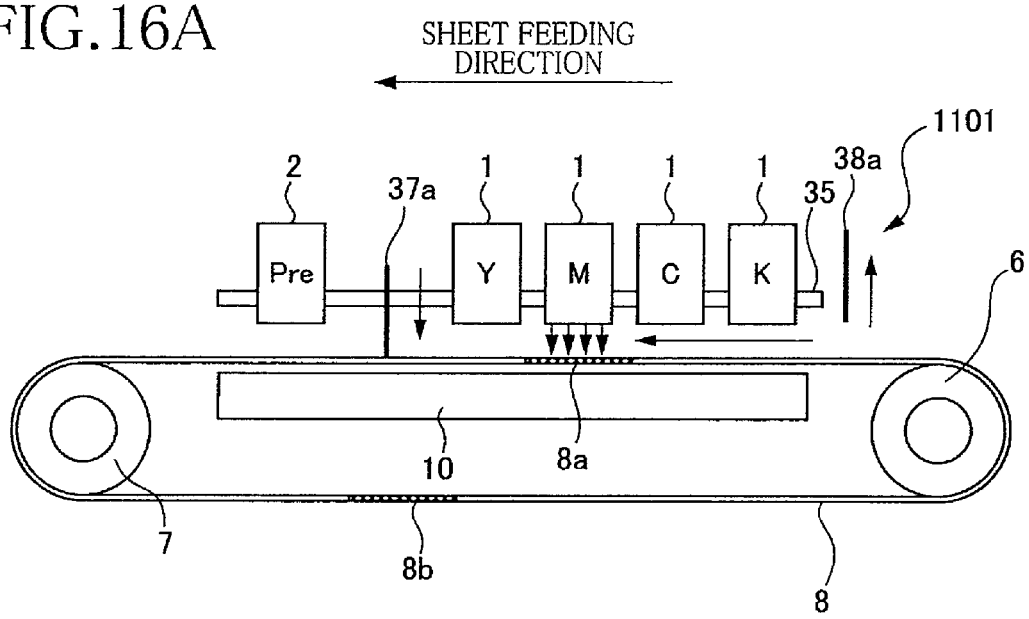

An ink-jet printer 1101 constructed according to an eleventh embodiment of this invention will be described. The same reference signs as used in the first embodiment will be used to identify substantially the same elements of the ink-jet printer 1101 as those of the ink-jet printer 101 of the first embodiment. As shown in FIG. 16A, the pre-coating head 2 is disposed downstream of the ink-jet heads 2 in the feeding direction of the paper sheet P, and the blade 37*a* is disposed in opposition to a flat part of the upper span of the loop of the sheet conveyor belt 8, which is downstream of the ink-jet heads 1 and upstream of the pre-coating head 2, while the blade 38*a* is disposed in opposition to a flat part of the upper span, which is upstream of the ink-jet heads 1.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 16B:
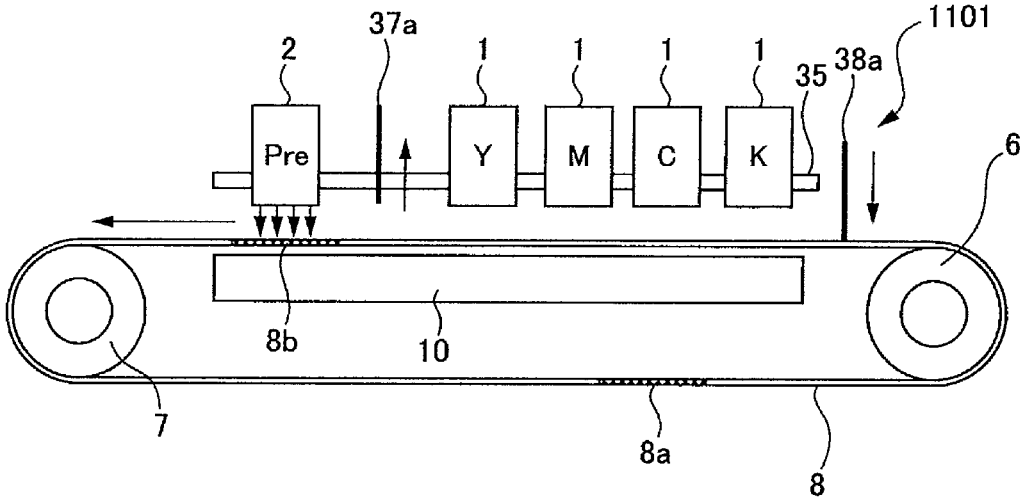

Then, the cleaner control portion 47 controls the blade moving mechanisms to move the blade 37*a* to its retracted position and to move blade 38*a* to the cleaning position while the sheet conveyor belt 8 is further rotated in the sheet feeding direction, as indicated in FIG. 16B. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 1101 constructed according to the eleventh embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ink-jet printer 1101 do not require reversal of the rotating direction of the sheet conveyor belt 8 (feeding direction of the paper sheet P) when the pre-coating liquid is ejected onto and scraped off from the liquid-receiving area 8*b* after the inks are ejected onto and scraped off from the ink-receiving area 8*a*, so that the discharging and scraping operations of the inks and pre-coating liquid can be performed continuously, making it possible to reduce the time required for the maintenance operation.

Twelfth Embodiment

Figure 17A:
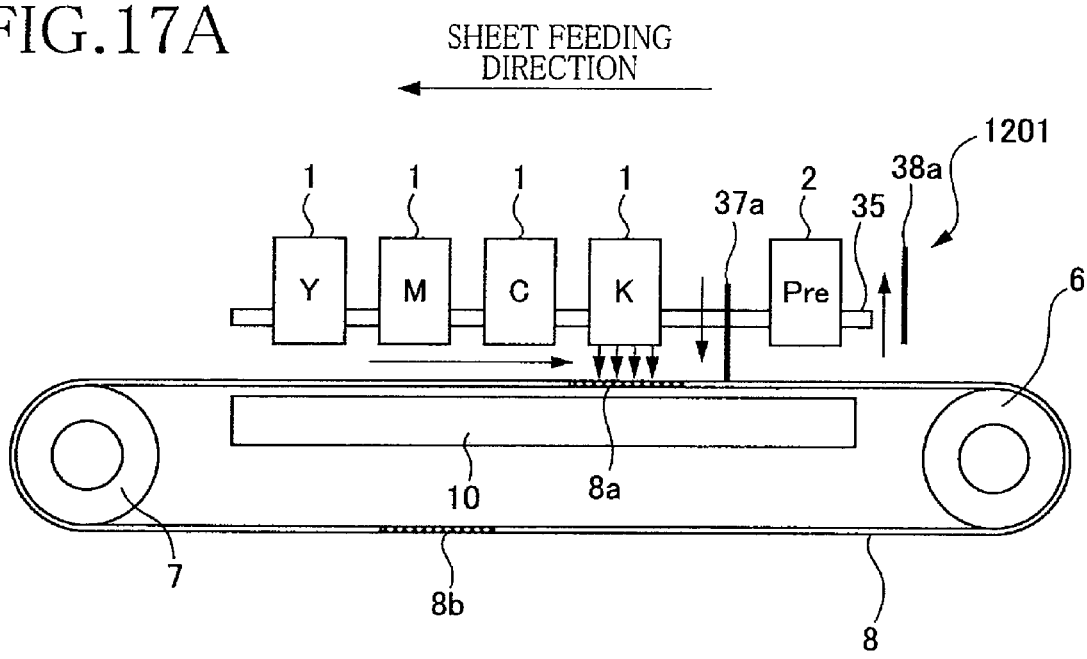

An ink-jet printer 1201 constructed according to a twelfth embodiment of this invention will be described. The same reference signs as used in the first embodiment will be used to identify substantially the same elements of the ink-jet printer 1201 as those of the ink-jet printer 101 of the first embodiment. As shown in FIG. 17A, the pre-coating head 2 is disposed upstream of the ink-jet heads 2 in the feeding direction of the paper sheet P, and the blade 37*a* is disposed in opposition to a flat part of the upper span of the loop of the sheet conveyor belt 8, which is upstream of the ink-jet heads 1 and downstream of the pre-coating head 2, while the blade 38*a* is disposed in opposition to a flat part of the upper span, which is upstream of the pre-coating head 2.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the direction opposite to the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 17B:
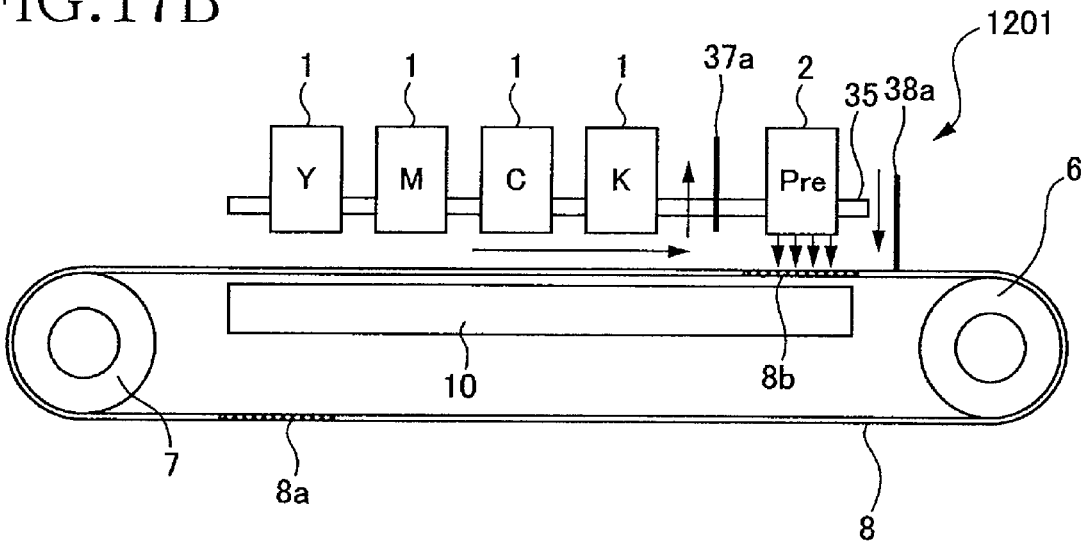

Then, the cleaner control portion 47 controls the blade moving mechanisms to move the blade 37*a* to its retracted position and to move blade 38*a* to the cleaning position while the sheet conveyor belt 8 is further rotated in the direction opposite to the sheet feeding direction, as indicated in FIG. 17B. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 1201 constructed according to the twelfth embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ink-jet printer 1201 do not require reversal of the rotating direction of the sheet conveyor belt 8 (feeding direction of the paper sheet P) when the pre-coating liquid is ejected onto and scraped off from the liquid-receiving area 8*b* after the inks are ejected onto and scraped off from the ink-receiving area 8*a*, so that the discharging and scraping operations of the inks and pre-coating liquid can be performed continuously, making it possible to reduce the time required for the maintenance operation.

Thirteenth Embodiment

Figure 18A:
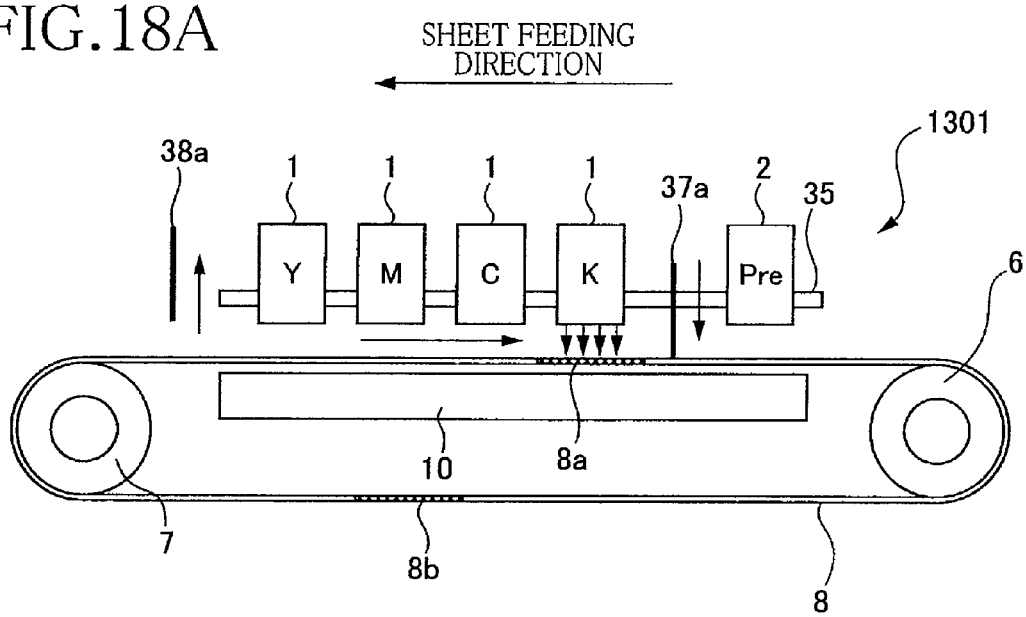

An ink-jet printer 1301 constructed according to a thirteen embodiment of this invention will be described. The same reference signs as used in the first embodiment will be used to identify substantially the same elements of the ink-jet printer 1301 as those of the ink-jet printer 101 of the first embodiment. As shown in FIG. 18A, the pre-coating head 2 is disposed upstream of the ink-jet heads 1 as seen in the feeding direction of the paper sheet P, and the blade 37*a* is disposed in opposition to a flat part of the upper span of the loop of the sheet conveyor belt 8, which is upstream of the ink-jet heads 1 and downstream of the pre-coating head 2, while the blade 38*a* is disposed in opposition to a flat part of the upper span, which is downstream of the ink-jet heads 1.

During the maintenance operation, the cleaner control portion 47 controls the blade moving mechanisms to move the blade 37*a* of the ink cleaner 37 to the cleaning position and to move the blade 38*a* of the pre-coat cleaner 38 to the retracted position, and the sheet transfer control portion 50 controls the sheet transfer motor of the sheet transfer unit 20 to rotate the sheet conveyor belt 8 in the direction opposite to the sheet feeding direction. As the ink-receiving area 8*a* is moved by the rotary motion of the sheet conveyor belt 8, the purging control portion 44 controls the ink pumps 32 to eject the predetermined amounts of the black, cyan, magenta and yellow inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the blade 37*a* before the ink-receiving area 8*a* reaches the positions of the blade 38*a* and the pre-coating head 2, and the blade 37*a* placed in the cleaning position scrapes off the inks ejected onto the ink-receiving area 8*a*.

Figure 18B:
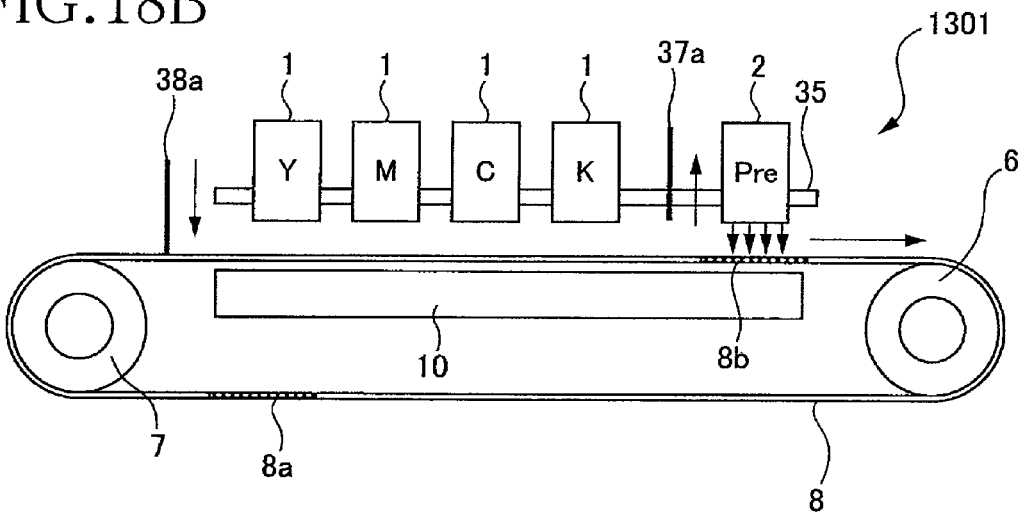

Then, the cleaner control portion 47 controls the blade moving mechanisms to move the blade 37*a* to its retracted position and to move blade 38*a* to the cleaning position while the sheet conveyor belt 8 is further rotated in the direction opposite to the sheet feeding direction, as indicated in FIG. 18B. Then, the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the blade 38*a* before the liquid-receiving area 8*b* reaches the positions of the blade 37*a* and the four ink-jet heads 1, and the blade 38*a* placed in the cleaning position scrapes off the pre-coating liquid ejected onto the liquid-receiving area 8*b*.

The ink-jet printer 1301 constructed according to the thirteenth embodiment of the invention performs the maintenance operation wherein the inks ejected onto the ink-receiving area 8*a* are scraped off from the in-receiving area 8*a* by the blade 37*a*, without the ink-receiving area 8*a* reaching the positions of the parts of the conveyor belt 8 to which the pre-coating head 2 and blade 38*a* are opposed, and the pre-coating liquid ejected onto the liquid-receiving area 8*b* is scraped off by the blade 38*a*, without the liquid-receiving area 8*b* reaching the positions of the parts of the conveyor belt 8 to which the four ink-jet heads 1 and the blade 37*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

Further, the ink-jet printer 1301 do not require reversal of the rotating direction of the sheet conveyor belt 8 (feeding direction of the paper sheet P) when the pre-coating liquid is ejected onto and scraped off from the liquid-receiving area 8*b* after the inks are ejected onto and scraped off from the ink-receiving area 8*a*, so that the discharging and scraping operations of the inks and pre-coating liquid can be performed continuously, making it possible to reduce the time required for the maintenance operation.

Fourteenth Embodiment

Figure 19:
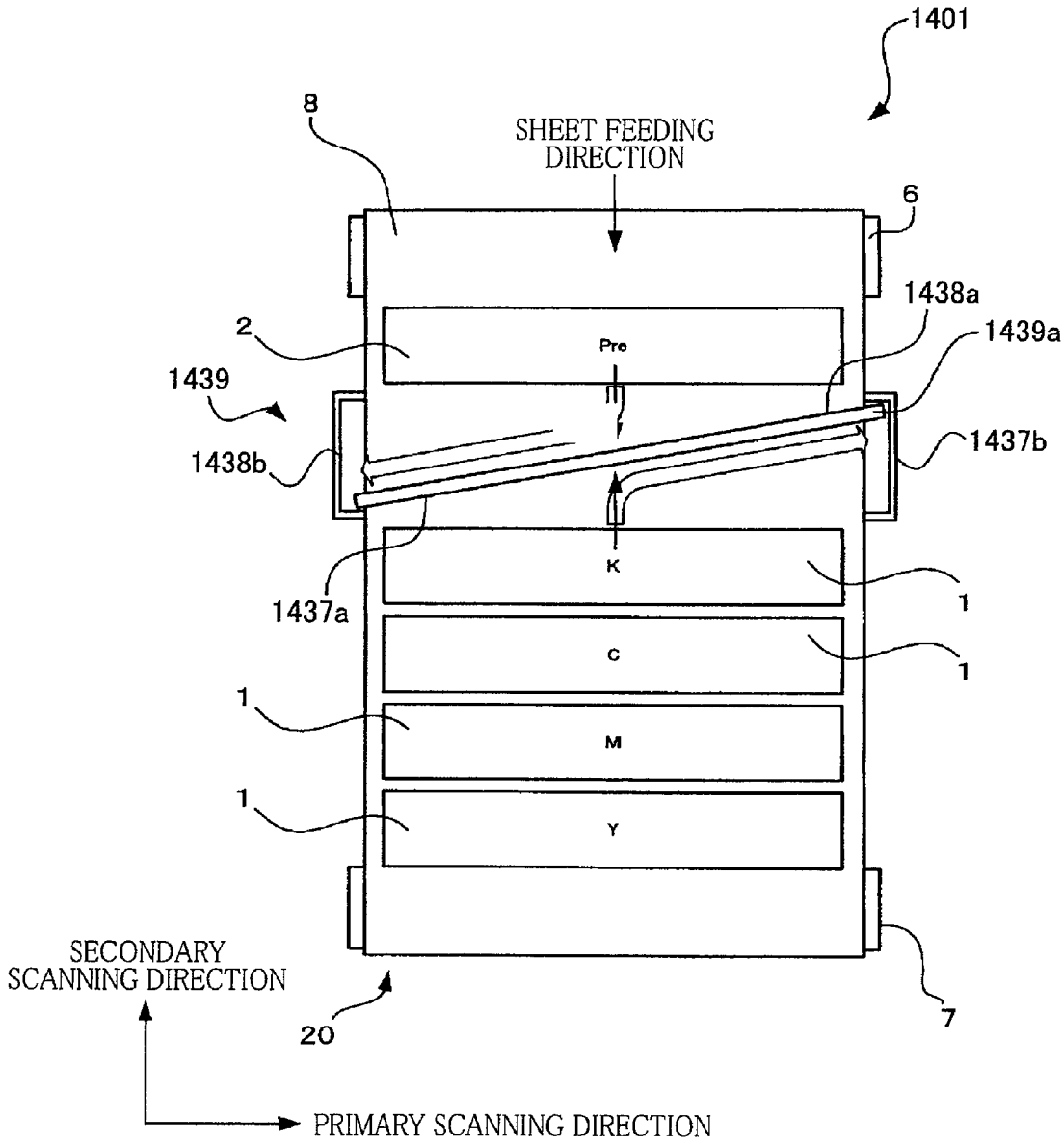
FIG. 19 is a schematic plan view of an ink-jet printer constructed according to a fourteenth embodiment of the invention.

An ink-jet printer 1401 constructed according to a fourteen embodiment of this invention will be described. The same reference signs as used in the first embodiment will be used to identify substantially the same elements of the ink-jet printer 1401 as those of the ink-jet printer 101 of the first embodiment. As shown in FIG. 19, the ink-jet printer 1401 includes a cleaner portion 1439 having a one-piece blade 1439*a*, an ink receiver 1437*b* and a pre-coating-liquid receiver 1438*b*. The blade 1439*a* is disposed upstream of the four ink-jet heads 1 and downstream of the pre-coating head 2 in the feeding direction of the paper sheet P, and is disposed in opposition to a flat part of the upper span of the loop of the sheet conveyor belt 8. Further, the blade 1439*a* extends across the entire width of the sheet conveyor belt 8 such that the direction of extension of the blade 1439*a* is inclined by about 10 degrees with respect to the primary scanning direction perpendicular to the sheet feeding direction, with the left end of the blade 1439*a* (as seen in FIG. 19) being located downstream of the right end in the sheet feeding direction. The blade 1439*a* has opposite parallel surfaces 1437*a* and 1438*a*. The surface 1437*a* disposed downstream of the other surface 1438*a* in the sheet feeding direction serves as an ink scraping surface for scraping the inks ejected onto the ink-receiving area 8*a*, while the other surface disposed upstream of the surface 1437*a* serves as a pre-coating-liquid scraping surface for scraping the pre-coating liquid from the liquid-receiving area 8*b*. The blade 1439*a* is movable by a moving mechanism to a selected one of the cleaning position at which the lower end of the blade 1439*a* is in abutting contact with the upper span of the sheet conveyor belt 8, and retracted position at which the lower end is spaced apart from the upper span.

The upstream end portion of the blade 1439*a* as seen in the sheet feeding direction (right end portion of the blade 1439*a* as seen in FIG. 19) is located at the upstream end portion of the ink receiver 1437*b*, while the downstream or left end portion of the blade 1439*a* is located at the downstream end portion of the pre-coating-liquid receiver 1438*b*.

During the maintenance operation, the cleaner control portion 47 controls the blade moving mechanism to move the blade 1439*a* of the cleaner portion 1439 to the cleaning position, and the sheet transfer control portion 50 controls the sheet transfer motor of the sheet transfer unit 20 to rotate the sheet conveyor belt 8 in the direction opposite to the sheet feeding direction. As the ink-receiving area 8*a* is moved by the rotary motion of the sheet conveyor belt 8, the purging control portion 44 controls the ink pumps 32 to eject the predetermined amounts of the inks from the ink-ejecting nozzles 108 of the respective four ink-jet heads 1 onto the ink-receiving area 8*a* when the ink-receiving area 8*a* is successively opposed to the respective ink-jet heads 1. Subsequently, the ink-receiving area 8*a* reaches the position of the ink scraping surface 1437*a* before the ink-receiving area 8*a* reaches the position of the pre-coating-liquid scraping surface 1438*a* of the blade 1439*a* and the pre-coating head 2, and the ink scraping surface 1437*a* scrapes off the inks ejected onto the ink-receiving area 8*a*. The inks scraped off by the ink scraping surface 1437*a* are moved rightwards as seen in FIG. 19 and fall downwards into the ink receiver 1437*b* and accommodated in the waste-ink reservoir 37*c*.

Then, the sheet transfer control portion 50 controls the sheet transfer motor of the sheet transfer unit 20 to rotate the sheet conveyor belt 8 in the sheet feeding direction, and the purging control portion 44 controls the pre-coating pump 33 to eject the predetermined amount of the pre-coating liquid from the liquid-ejecting nozzles of the pre-coating head 2 onto the liquid-receiving area 8*b* when the liquid-receiving area 8*b* is opposed to the pre-coating head 2. Subsequently, the liquid-receiving area 8*b* reaches the position of the pre-coating-liquid scraping surface 1438*a* before the liquid-receiving area 8*b* reaches the positions of the ink scraping surface 1437*a* of the blade 149*a* and the four ink-jet heads 1, and the pre-coating-liquid scraping surface 1438*a* scrapes off the pre-coating liquid ejected onto the liquid-receiving area 8*b*. The pre-coating liquid scraped off by the pre-coating-liquid scraping surface 1438*a* is moved leftwards as seen in FIG. 19 and fall downwards into the pre-coating-liquid receiver 1438*b* and accommodated in the waste-liquid reservoir 38*c*.

The ink-jet printer 1401 constructed according to the fourteen embodiment of the invention performs the maintenance operation wherein the inks ejected onto the ink-receiving area 8*a* are scraped off from the in-receiving area 8*a* by the ink scraping surface 1437*a*, without the ink-receiving area 8*a* reaching the positions of the parts of the conveyor belt 8 to which the pre-coating head 2 and pre-coating-liquid scraping surface 1438*a*, and the pre-coating liquid ejected onto the liquid-receiving area 8*b* is scraped off by the pre-coating-liquid scraping surface 1438*a*, without the liquid-receiving area 8*b* reaching the positions of the conveyor belt 8 to which the four ink-jet heads 1 and the ink scraping surface 1437*a* are opposed. Thus, the inks ejected onto the ink-receiving area 8*a* and the pre-coating liquid ejected onto the liquid-receiving area 8*b* do not mix with each other, thereby preventing production of substances as a result of aggregation (cohesion) or deposition (precipitation) of the chromogenic components of the inks by the pre-coating liquid. Further, the ink-receiving area 8*a* is not fed under the pre-coating head 2, and the liquid-receiving area 8*b* is not fed under the ink-jet heads 1, so that the ink ejected from the ink-jet heads 1 do not adhere to the liquid-ejecting nozzles of the pre-coating head 2, and the pre-coating liquid ejected from the pre-coating head 2 do not adhere to the ink-ejecting nozzles 108 of the ink-jet heads 1.

The provision of the single blade 1439*a* permits the ejected inks and pre-coating liquid to be scraped off from the sheet conveyor belt 8, making it possible to reduce the size of the ink-jet printer 1401.

While the preferred embodiments of this invention have been described for illustrative purpose only, it is to be understood that the present invention is not limited to the details of the illustrated embodiments, but may be embodied with various changes and modifications, which may occur to those skilled in the art, without departing from the spirit and scope of the present invention defined in the appended claims. The inks and pre-coating liquid ejected during the maintenance operation are both scraped off from the ink-receiving area 8*a* and liquid-receiving area 8*b* while these areas 8*a*, 8*b* are moved downwards along the convex parts of the circumference of the driving and driven rollers 7, 6 in the first embodiment, and moved in the horizontal direction as the flat parts of the upper span of the sheet conveyor belt 8 in the second through thirteenth embodiments. However, the illustrated ink-jet printers may be modified such that the inks are be scraped off from the area 8*a* while the area 8*a* is moved downwards along the convex part of the circumference of the driving belt roller 7 while the pre-coating liquid are be scraped off from the area 8*b* while the area 8*b* is moved in the horizontal direction, or vice versa.

In the illustrated first through fourteenth embodiments, the ejected inks and the ejected pre-coating liquid are accommodated in the respective waste-ink reservoir 37*c* and waste-liquid reservoir 38*c* through the respective different passages. However, the ejected inks and pre-coating liquid may be accommodated in the same waste reservoir through the same passage or respective different passages.

In the illustrated first through thirteenth embodiments, the inks are ejected onto the ink-receiving area 8*a* while the pre-coating liquid is ejected onto the liquid-receiving area 8*b*. However, the inks and pre-coating liquid may be ejected onto the same area of the sheet conveyor belt 8, and the inks or the pre-coating liquid may be ejected onto an arbitrarily selected area of the sheet conveyor belt 8.

In the illustrated embodiments, the ink-jet printer has the four ink-jet heads 1 configured to eject droplets of the respective four different colors of inks. However, the principle of the present invention is applicable to an ink-jet printer having two, three or five or more ink-jet heads configured to eject droplets of respective different colors of inks, or an ink-jet printer having a single ink-jet head configured to eject droplets of respective different colors of inks and a pre-coating liquid.

It is to be understood that the principle of the present invention is equally applicable to any liquid-ejecting apparatus configured to eject a liquid other than an ink or inks. The liquid-ejecting apparatus may be a facsimile apparatus or a copying apparatus, or a multi-function apparatus having at least one function (e.g., facsimile and copying functions) other than a printing function.

What is claimed is:

1. A liquid ejecting apparatus comprising:

a medium transfer mechanism including a conveyor belt for feeding a recording medium, the conveyor belt having a medium support surface on which the recording medium is placed;

a first-liquid ejecting head having first ejecting nozzles for ejecting a first liquid to form an image on the recording medium being fed by the conveyor belt in a feeding direction;

a second-liquid ejecting head spaced apart from the first-liquid ejecting head in the feeding direction and having second ejecting nozzles for ejecting a second liquid which causes aggregation or deposition of components of the first liquid;

a first-liquid ejection control portion configured to control the first-liquid ejecting head to eject the first liquid from the first ejecting nozzles onto the medium support surface of the conveyor belt;

a second-liquid ejection control portion configured to control the second-liquid ejecting head to eject the second liquid from the second ejecting nozzles onto the medium support surface of the conveyor belt;

a first cleaning mechanism including a first removing member configured to contact the medium support surface and remove the first liquid from the medium support surface;

a second cleaning mechanism including a second removing member configured to contact the medium support surface and remove the second liquid from the medium support surface; and a medium transfer and cleaning control portion configured to control the medium transfer mechanism and the first and second cleaning mechanisms, wherein the medium transfer and cleaning control portion control the medium transfer mechanism and the first cleaning mechanism, after the first liquid is ejected from the first ejecting nozzles onto the medium support surface under the control of the first-liquid ejection control portion, to enable the first removing member to remove the ejected first liquid from the medium support surface, without the first liquid on the medium support surface reaching a position of a part of the conveyor belt to which the second removing member is opposed, and controls the medium transfer mechanism and the second cleaning mechanism, after the second liquid is ejected from the second ejecting nozzles onto the medium support surface under the control of the second-liquid ejection control portion, to enable the second removing member to remove the ejected second liquid from the medium support surface, without the second liquid on the medium support surface reaching a position of another part of the conveyor belt to which the first removing member is opposed, wherein the first-liquid ejecting head is disposed downstream of the second-liquid ejecting head in the feeding direction of the recording medium, and the first removing member is disposed downstream of the first-liquid ejecting head in the feeding direction, while the second removing member is disposed upstream of the second-liquid ejecting head in the feeding direction, and wherein the medium transfer and cleaning control portion controls the medium transfer mechanism to rotate the conveyor belt in the feeding direction when the first liquid ejected onto the medium support surface is removed by the first removing member, and to rotate the conveyor belt in a direction opposite to the feeding direction when the second liquid ejected onto the medium support surface is removed by the second removing member.

2. The liquid ejecting apparatus according to claim 1, wherein the first cleaning mechanism includes a first storing portion for storing the first liquid removed by the first removing member from the medium support surface, and a passage through which the first liquid removed by the first removing member is moved into the first storing portion, and the second cleaning mechanism includes a second storing portion for storing the second liquid removed by the second removing portion from the medium support surface, and a passage through which the second liquid removed by the second removing member is moved into the second storing portion, and wherein the passages of the first and second cleaning mechanisms do not communicate with each other.

3. The liquid ejecting apparatus according to claim 1, wherein each of at least one of the first and second removing members is disposed in opposition to a flat part of an upper span of the conveyor belt, to remove a corresponding one of the first and second liquids from an area of the medium support surface when the area in which the corresponding liquid has been ejected is opposed to said each removing member.

4. The liquid ejecting apparatus according to claim 1, wherein each of at least one of the first and second removing members is disposed in opposition to a curved part of an outwardly convex part of the conveyor belt, to remove a corresponding one of the first and second liquids from an area of the medium support surface when the area in which the corresponding liquid has been ejected is opposed to said each removing member.

5. The liquid ejecting apparatus according to claim 1, wherein the medium transfer and cleaning control portion and the first and second ejection control portions respectively control the medium transfer mechanism and the first-liquid and second-liquid ejecting heads, to enable the first-liquid and second-liquid ejecting heads to eject the respective first and second liquids from the respective first and second ejecting nozzles onto respective first and second areas of the medium support surface of the medium conveyor belt which are spaced apart from each other in the feeding direction of the recording medium.

6. A liquid ejecting apparatus comprising:

a medium transfer mechanism including a conveyor belt for feeding a recording medium, the conveyor belt having a medium support surface on which the recording medium is placed;

a first-liquid ejecting head having first ejecting nozzles for ejecting a first liquid to form an image on the recording medium being fed by the conveyor belt in a feeding direction;

a second-liquid ejecting head spaced apart from the first-liquid ejecting head in the feeding direction and having second ejecting nozzles for ejecting a second liquid which causes aggregation or deposition of components of the first-liquid;

a first-liquid ejection control portion configured to control the first-liquid ejecting head to eject the first liquid from the first ejecting nozzles onto the medium support surface of the conveyor belt;

a second-liquid ejection control portion configured to control the second-liquid ejecting head to eject the second liquid from the second ejecting nozzles onto the medium support surface of the conveyor belt;

a first cleaning mechanism including a first removing member configured to contact the medium support surface and remove the first liquid from the medium support surface;

a second cleaning mechanism including a second removing member configured to contact the medium support surface and remove the second liquid from the medium support surface; and a medium transfer and cleaning control portion configured to control the medium transfer mechanism and the first and second cleaning mechanisms, wherein the medium transfer and cleaning control portion control the medium transfer mechanism and the first cleaning mechanism, after the first liquid is ejected from the first ejecting nozzles onto the medium support surface under the control of the first-liquid ejection control portion, to enable the first removing member to remove the ejected first liquid from the medium support surface, without the first liquid on the medium support surface reaching a position of a part of the conveyor belt to which the second removing member is opposed, and controls the medium transfer mechanism and the second cleaning mechanism, after the second liquid is ejected from the second ejecting nozzles onto the medium support surface under the control of the second-liquid ejection control portion, to enable the second removing member to remove the ejected second liquid from the medium support surface, without the second liquid on the medium support surface reaching a position of another part of the conveyor belt to which the first removing member is opposed, wherein the first-liquid ejecting head is disposed downstream of the second-liquid ejecting heads in the feeding direction of the recording medium, and the first and second removing members are disposed between the first-liquid ejecting head and the second-liquid ejecting head in the feeding direction such that the first removing member is disposed downstream of the second removing member in the feeding direction, and wherein the medium transfer and cleaning control portion controls the medium transfer mechanism to rotate the conveyor belt in a direction opposite to the feeding direction when the first liquid ejected onto the medium support surface is removed by the first removing member, and to rotate the conveyor belt in the feeding direction when the second liquid ejected onto the medium support surface is removed by the second removing member.

7. The liquid ejecting apparatus according to claim 6, wherein the first cleaning mechanism includes a first storing portion for storing the first liquid removed by the first removing member from the medium support surface, and a passage through which the first liquid removed by the first removing member is moved into the first storing portion, and the second cleaning mechanism includes a second storing portion for storing the second liquid removed by the second removing portion from the medium support surface, and a passage through which the second liquid removed by the second removing member is moved into the second storing portion, and wherein the passages of the first and second cleaning mechanisms do not communicate with each other.

8. The liquid ejecting apparatus according to claim 6, wherein each of at least one of the first and second removing members is disposed in opposition to a flat part of an upper span of the conveyor belt, to remove a corresponding one of the first and second liquids from an area of the medium support surface when the area in which the corresponding liquid has been ejected is opposed to said each removing member.

9. The liquid ejecting apparatus according to claim 6, wherein each of at least one of the first and second removing members is disposed in opposition to a curved part of an outwardly convex part of the conveyor belt, to remove a corresponding one of the first and second liquids from an area of the medium support surface when the area in which the corresponding liquid has been ejected is opposed to said each removing member.

10. The liquid ejecting apparatus according to claim 6, wherein each of the first and second removing members comprise a one-piece blade which extends over an entire width of the medium support surface of the medium conveyor belt in a direction intersecting the feeding direction of the recording medium and which is configured to be in an abutting contact with the medium support surface.

11. The liquid ejecting apparatus according to claim 6, wherein the medium transfer and cleaning control portion and the first and second ejection control portions respectively control the medium transfer mechanism and the first-liquid and second-liquid ejecting heads, to enable the first-liquid and second-liquid ejecting heads to eject the respective first and second liquids from the respective first and second ejecting nozzles onto respective first and second areas of the medium support surface of the medium conveyor belt which are spaced apart from each other in the feeding direction of the recording medium.

12. A liquid ejecting apparatus comprising:

a medium transfer mechanism including a conveyor belt for feeding a recording medium, the conveyor belt having a medium support surface on which the recording medium is placed;

a first-liquid ejecting head having first ejecting nozzles for ejecting a first liquid to form an image on the recording medium being fed by the conveyor belt in a feeding direction;

a second-liquid ejecting head spaced apart from the first-liquid ejecting head in the feeding direction and having second ejecting nozzles for ejecting a second liquid which causes aggregation or deposition of components of the first liquid;

a first-liquid ejection control portion configured to control the first-liquid ejecting head to eject the first liquid from the first ejecting nozzles onto the medium support surface of the conveyor belt;

a second-liquid ejection control portion configured to control the second-liquid ejecting head to eject the second liquid from the second ejecting nozzles onto the medium support surface of the conveyor belt;

a first cleaning mechanism including a first removing member configured to contact the medium support surface and remove the first liquid from the medium support surface;

a second cleaning mechanism including a second removing member configured to contact the medium support surface and remove the second liquid from the medium support surface; and a medium transfer and cleaning control portion configured to control the medium transfer mechanism and the first and second cleaning mechanisms, wherein the medium transfer and cleaning control portion control the medium transfer mechanism and the first cleaning mechanism, after the first liquid is ejected from the first ejecting nozzles onto the medium support surface under the control of the first-liquid ejection control portion, to enable the first removing member to remove the ejected first liquid from the medium support surface, without the first liquid on the medium support surface reaching a position of a part of the conveyor belt to which the second removing member is opposed, and controls the medium transfer mechanism and the second cleaning mechanism, after the second liquid is ejected from the second ejecting nozzles onto the medium support surface under the control of the second-liquid ejection control portion, to enable the second removing member to remove the ejected second liquid from the medium support surface, without the second liquid on the medium support surface reaching a position of another part of the conveyor belt to which the first removing member is opposed, wherein the first-liquid ejecting head is disposed downstream of the second-liquid ejecting head in the feeding direction of the recording medium, and the first removing member is disposed between the first-liquid ejecting head and the second-liquid ejecting head in the feeding direction, while the second removing member is not disposed between the first-liquid ejecting head and the second-liquid ejecting head in the feeding direction, and wherein the medium transfer and cleaning control portion controls the medium transfer mechanism to rotate the conveyor belt in a direction opposite to the feeding direction when the first liquid ejected onto the medium support surface is removed by the first removing member, and also when the second liquid ejected onto the medium support surface is removed by the second removing member.

13. The liquid ejecting apparatus according to claim 12, wherein the first cleaning mechanism includes a first storing portion for storing the first liquid removed by the first removing member from the medium support surface, and a passage through which the first liquid removed by the first removing member is moved into the first storing portion, and the second cleaning mechanism includes a second storing portion for storing the second liquid removed by the second removing portion from the medium support surface, and a passage through which the second liquid removed by the second removing member is moved into the second storing portion, and wherein the passages of the first and second cleaning mechanisms do not communicate with each other.

14. The liquid ejecting apparatus according to claim 12, wherein each of at least one of the first and second removing members is disposed in opposition to a flat part of an upper span of the conveyor belt, to remove a corresponding one of the first and second liquids from an area of the medium support surface when the area in which the corresponding liquid has been ejected is opposed to said each removing member.

15. The liquid ejecting apparatus according to claim 12, wherein each of at least one of the first and second removing members is disposed in opposition to a curved part of an outwardly convex part of the conveyor belt, to remove a corresponding one of the first and second liquids from an area of the medium support surface when the area in which the corresponding liquid has been ejected is opposed to said each removing member.

16. The liquid ejecting apparatus according to claim 12, wherein the medium transfer and cleaning control portion and the first and second ejection control portions respectively control the medium transfer mechanism and the first-liquid and second-liquid ejecting heads, to enable the first-liquid and second-liquid ejecting heads to eject the respective first and second liquids from the respective first and second ejecting nozzles onto respective first and second areas of the medium support surface of the medium conveyor belt which are spaced apart from each other in the feeding direction of the recording medium.

* * * * *